US011566184B2

(12) United States Patent
Abbaspour et al.

(10) Patent No.: US 11,566,184 B2
(45) Date of Patent: Jan. 31, 2023

(54) NON-AQUEOUS EXTRACTION AND SEPARATION OF BITUMEN FROM OIL SANDS ORE WITH ROTATING ELEMENTS

(71) Applicant: SUNCOR ENERGY INC., Calgary (CA)

(72) Inventors: Ali Abbaspour, Calgary (CA); Jiayi Claire Cao, Calgary (CA); Farid Vaezi Ghobaeiyeh, Calgary (CA); Martin Hadzima, Calgary (CA); Iftikhar Huq, Calgary (CA)

(73) Assignees: SUNCOR ENERGY INC., Calgary (CA); EXERGY SOLUTIONS, Calgary (CA)

( * ) Notice: Subject to any disclaimer, the term of this patent is extended or adjusted under 35 U.S.C. 154(b) by 0 days.

(21) Appl. No.: 17/683,839

(22) Filed: Mar. 1, 2022

(65) Prior Publication Data

US 2022/0282162 A1 Sep. 8, 2022

(51) Int. Cl.
*C10G 1/04* (2006.01)

(52) U.S. Cl.
CPC ..... *C10G 1/045* (2013.01)

(58) Field of Classification Search
CPC ..... C10G 1/045
See application file for complete search history.

(56) References Cited

U.S. PATENT DOCUMENTS 4,120,775 A * 10/1978 Murray ..... B03B 9/02 196/14.52
2021/0047569 A1 2/2021 Huq et al.

FOREIGN PATENT DOCUMENTS

| | | | |
|---|---|---|---|
| CA | 2937235 | A1 | 9/2016 |
| CA | 3016908 | A1 | 3/2020 |
| CA | 3051780 | A1 | 3/2020 |
| CA | 3051955 | A1 | 2/2021 |

* cited by examiner

*Primary Examiner* — Randy Boyer
*Assistant Examiner* — Juan C Valencia
(74) *Attorney, Agent, or Firm* — WCF IP

(57) ABSTRACT

Rotating elements receivable within an extractor trough of an extractor configured for non-aqueous extraction of bitumen from oil sands are described. The rotating element can include a shaft operatively couplable to a motor, and projections extending outwardly from the shaft and being removably secured thereto. The rotating element can also include a shaft mounting structure couplable to a shaft, comprising a shaft receiving hub configured for receiving the shaft therein. The rotation of the rotating element can provide digestion and extraction of bitumen from the oil sands while advancing solids in a downstream direction within the extractor trough, as solvent diluted bitumen flows in an upstream direction toward a liquid outlet. Methods for servicing a rotating element and for manufacturing a non-aqueous extraction (NAE) extractor are also provided.

23 Claims, 21 Drawing Sheets

NON-AQUEOUS EXTRACTION AND SEPARATION OF BITUMEN FROM OIL SANDS ORE WITH ROTATING ELEMENTS

RELATED PATENT APPLICATION

This application claims priority from Canadian patent application No. 3,111,408, filed on Mar. 5, 2021, and titled "NON-AQUEOUS EXTRACTION AND SEPARATION OF BITUMEN FROM OIL SANDS ORE WITH ROTATING ELEMENTS", the disclosure of which is hereby incorporated by reference in its entirety.

TECHNICAL FIELD

The technical field generally relates to processing oil sands ore, and more particularly to techniques using a hydrocarbon solvent, such as a paraffinic solvent, to facilitate the extraction and separation of bitumen from mined oil sands.

BACKGROUND

Conventional methods for the extraction of bitumen from oil sands rely on mixing the oil sands with water to form an aqueous slurry and then separating the slurry into fractions including bitumen froth and aqueous tailings. The bitumen froth is then treated to remove residual water and solids, while the aqueous tailings are stored in tailings ponds and/or subjected to further processing. Water-based extraction methods have various challenges related to water demand and processing requirements; energy requirements to heat aqueous streams to operating temperatures to facilitate extraction; as well as the production, handling and disposal of aqueous tailings materials.

SUMMARY

In accordance with an aspect, there is provided a rotating element receivable within an extractor trough of an extractor configured for non-aqueous extraction of bitumen from oil sands, the rotating element comprising:

- a shaft operatively couplable to a motor configured for driving a rotation of the shaft; and
- projections extending outwardly from the shaft and being removably secured thereto;
- wherein the rotation of the rotating element provides digestion and extraction of bitumen from the oil sands while advancing solids in a downstream direction within the extractor trough, as solvent diluted bitumen accumulates in an upper region of the extractor trough and flows in an upstream direction toward a liquid outlet.

In some implementations, the shaft has an edgeless cross-section and comprises elongated slots extending in circumferential arcs around the shaft, and a corresponding one of the projections is provided along a corresponding one of the elongated slots for being removably secured to the shaft.

In some implementations, adjacent ones of the elongated slots are provided in an offset configuration.

In some implementations, a first set of two elongated slots is provided in a spaced-apart relationship around a first circumferential arc of the shaft, a second set of two elongated slots is provided in a spaced-apart relationship around a second circumferential arc of the shaft, the first and second sets of the elongated slots being longitudinally spaced-apart from one another.

In some implementations, a first subcomponent of two projections is provided along the first set of two elongated slots and a second subcomponent of two projections is provided along the second set of two elongated slots, each one of the projections of the first and second subcomponents of projections extending in a given quadrant defined around the shaft.

In some implementations, a first subcomponent of two projections is provided along the first set of two elongated slots and a second subcomponent of two projections is provided along the second set of two elongated slots, each one of the projections of the first and second subcomponents of projections extending at an angle between about 45° and about 90° relative to each other.

In some implementations, the projections are removably secured to the shaft via a mounting assembly.

In some implementations, the mounting assembly is displaceable along the elongated slots to provide the projections in the offset configuration around the shaft.

In some implementations, the mounting assembly is configured to rotate about a transverse axis of the shaft to modify a positioning of the projections.

In some implementations, the mounting assembly is configured such that the corresponding one of the projections is oriented at an angle relative to a transverse plane extending perpendicularly to a longitudinal axis of the shaft.

In some implementations, the mounting assembly is configured such that the corresponding one of the projections is oriented parallel relative to a transverse plane extending perpendicularly to a longitudinal axis of the shaft.

In some implementations, the mounting assembly comprises a bracket.

In some implementations, the projections are removably secured to the shaft via a mounting assembly, and the mounting assembly comprises a single mechanical fastener extending across the shaft to secure two opposite projections of the first subcomponent of two projections or of the second subcomponent of two projections together.

In some implementations, adjacent ones of the projections are provided in an offset configuration.

In some implementations, a first subcomponent of two projections is provided longitudinally adjacent to a second subcomponent of two projections, each one of the projections of the first and second subcomponents of projections extending in a given quadrant defined around the shaft.

In some implementations, a first subcomponent of two projections is provided longitudinally adjacent to a second subcomponent of two projections, each one of the projections of the first and second subcomponents of projections extending at an angle between about 45° and about 90° relative to each other.

In some implementations, the shaft has a polygonal profile.

In some implementations, the shaft has at least four edges and four outer surfaces in between.

In some implementations, the projections of the first and second subcomponents of projections extend outwardly from a corresponding one of the four outer surfaces of the shaft.

In some implementations, the projections of the first subcomponent of projections are provided offset from the projections of the second subcomponent of projections relative to a longitudinal axis of the shaft.

In some implementations, the shaft has an edgeless profile.

In some implementations, the shaft has a circular profile.

In some implementations, the projections of the first subcomponent of projections are provided offset from the projections of the second subcomponent of projections relative to a longitudinal axis of the shaft.

In some implementations, the shaft comprises at least one support member extending outwardly therefrom for supporting a corresponding one of the projections.

In some implementations, the at least one support member and the corresponding one of the projections are integral with each other.

In some implementations, the projections are removably secured to the shaft via a corresponding dovetail joint.

In some implementations, the rotating element further comprises a mounting assembly for removably securing a corresponding one of the projections to the shaft.

In some implementations, the mounting assembly is configured such that the corresponding projection is oriented at an angle relative to a transverse plane extending perpendicularly to a longitudinal axis of the shaft.

In some implementations, the mounting assembly is configured such that the corresponding projection is oriented parallel relative to a transverse plane extending perpendicularly to a longitudinal axis of the shaft.

In some implementations, the mounting assembly comprises a shaft mounting plate for engagement with the shaft and a projection mounting plate for engagement with the corresponding projection.

In some implementations, the mounting assembly is configured to rotate about a transverse axis of the shaft to modify a positioning of the corresponding projection.

In some implementations, the corresponding one of the projections and the mounting assembly are integral with each other.

In some implementations, the projections are removably secured to the shaft via a mounting assembly, and the mounting assembly comprises a single mechanical fastener extending across the shaft to secure two opposite projections of the first subcomponent of two projections or of the second subcomponent of two projections together.

In some implementations, the shaft comprises a plurality of shaft segments.

In some implementations, the projections comprise sharpened edges to cut through the oil sands.

In accordance with another aspect, there is provided a rotating element receivable within an extractor trough of an extractor configured for non-aqueous extraction of bitumen from oil sands, the rotating element comprising:

a shaft mounting structure couplable to a shaft, comprising:

a shaft receiving hub having a shaft receiving hub profile and being configured for receiving the shaft therein; and projections extending outwardly from the shaft and being removably secured thereto via the shaft receiving hub;

wherein the rotation of rotating element provides digestion and extraction of bitumen from the oil sands while advancing solids in a downstream direction within the extractor trough, as solvent diluted bitumen accumulates in an upper region of the extractor trough and flows in an upstream direction toward a liquid outlet.

In some implementations, the shaft receiving hub profile is edgeless and the shaft receiving hub comprises elongated slots extending in circumferential arcs around the shaft receiving hub.

In some implementations, adjacent ones of the elongated slots are provided in an offset configuration.

In some implementations, a first set of two elongated slots is provided in a spaced-apart relationship around a first circumferential arc of the shaft receiving hub, a second set of two elongated slots is provided in a spaced-apart relationship around a second circumferential arc of the shaft receiving hub, the first and second sets of the elongated slots being longitudinally spaced-apart from one another.

In some implementations, the two elongated slots of the first set of two elongated slots extend in opposite direction, and the two elongated slots of the second set of two elongated slots at an angle between about 45° and about 90° relative to an adjacent one of the two elongated slots of the first set of two elongated slots.

In some implementations, the two elongated slots of the first set of two elongated slots extend in opposite direction, and the two elongated slots of the second set of two elongated slots at an angle of about 90° relative to an adjacent one of the two elongated slots of the first set of two elongated slots.

In some implementations, the shaft mounting structure further comprises a mounting assembly for removably engaging a corresponding one of the projections with the shaft receiving hub.

In some implementations, the mounting assembly is displaceable along the corresponding one of the elongate slots to provide the projections in an offset configuration around the shaft.

In some implementations, the mounting assembly is configured to rotate about a transverse axis of the shaft mounting structure to modify a positioning of the corresponding one of the projections.

In some implementations, the mounting assembly is configured such that the corresponding one of the projections is oriented at an angle relative to a transverse plane extending perpendicularly to a longitudinal axis of the shaft.

In some implementations, the mounting assembly is configured such that the corresponding projection is oriented parallel relative to a transverse plane extending perpendicularly to a longitudinal axis of the shaft.

In some implementations, the mounting assembly comprises a bracket.

In some implementations, the projections are removably secured to the shaft receiving hub via a mounting assembly, and the mounting assembly comprises a single mechanical fastener extending across the shaft receiving hub and the shaft to secure two opposite projections of the first subcomponent of two projections or of the second subcomponent of two projections together.

In some implementations, the shaft mounting structure comprises a plurality of shaft mounting structures mounted in series onto the shaft.

In some implementations, the plurality of shaft mounting structures are configured such that adjacent shaft receiving hubs interlock with each other.

In some implementations, the rotating element further comprises a retaining member at each end to retain the plurality of shaft mounting structures onto the shaft.

In some implementations, adjacent ones of the projections are provided in an offset configuration.

In some implementations, a first subcomponent of two projections is provided longitudinally adjacent to a second subcomponent of two projections, each one of the projections of the first and second subcomponents of projections extending in a given quadrant defined around the shaft.

In some implementations, a first subcomponent of two projections is provided longitudinally adjacent to a second subcomponent of two projections, each one of the projections of the first and second subcomponents of projections extending at an angle between about 45° and about 90° relative to each other.

In some implementations, the shaft has a shaft profile, and the shaft receiving hub profile is complementary to the shaft profile.

In some implementations, the shaft receiving hub profile is a polygonal profile.

In some implementations, the shaft receiving hub profile includes at least four edges and four outer surfaces.

In some implementations, the projections of the first and second subcomponents of projections extend outwardly from a corresponding one of the four outer surfaces of the shaft receiving hub.

In some implementations, the projections of the first subcomponent of projections are provided offset from the projections of the second subcomponent of projections relative to a longitudinal axis of the shaft.

In some implementations, the shaft receiving hub profile is an edgeless profile.

In some implementations, the shaft receiving hub profile is a circular profile.

In some implementations, the projections of the first subcomponent of projections are provided offset from the projections of the second subcomponent of projections relative to a longitudinal axis of the shaft.

In some implementations, the shaft mounting structure comprises at least one support member extending outwardly therefrom for supporting a corresponding one of the projections.

In some implementations, the at least one support member and the corresponding one of the projections are integral with each other.

In some implementations, the projections are removably secured to the shaft receiving hub via a corresponding dovetail joint.

In some implementations, the shaft receiving hub and the first and second subcomponents of two projections are integral with each other.

In some implementations, the shaft mounting structure further comprises a mounting assembly for removably securing a corresponding one of the projections to the shaft receiving hub.

In some implementations, the mounting assembly is configured such that the corresponding one of the projections is oriented at an angle relative to a transverse plane extending perpendicularly to a longitudinal axis of the shaft.

In some implementations, the mounting assembly is configured such that the corresponding projection is oriented parallel relative to a transverse plane extending perpendicularly to a longitudinal axis of the shaft.

In some implementations, the mounting assembly comprises a shaft mounting plate for engagement with the shaft receiving hub and a projection mounting plate for engagement with the corresponding one of the projections.

In some implementations, the mounting assembly is configured to rotate about a transverse axis of the shaft to modify a positioning of the corresponding projection.

In some implementations, the mounting assembly and the corresponding one of the projections are integral with each other.

In some implementations, the projections are removably secured to the shaft receiving hub via a mounting assembly, and the mounting assembly comprises a single mechanical fastener extending across the shaft and the shaft receiving hub to secure two opposite projections of the first subcomponent of two projections or of the second subcomponent of two projections together.

In some implementations, the shaft mounting structure comprises a plurality of shaft mounting structures each having a corresponding shaft receiving hub.

In some implementations, the plurality of shaft mounting structures are configured such that adjacent shaft receiving hubs interlock with each other.

In some implementations, the rotating element further comprises a retaining member at each end to retain the plurality of shaft mounting structures onto the shaft.

In some implementations, the projections comprise sharpened edges to cut through the oil sands.

In accordance with another aspect, there is provided a non-aqueous extraction process for producing a bitumen product from an oil sands material, comprising:

- supplying the oil sands material and a solvent-containing stream to an extractor configured for non-aqueous bitumen extraction, the extractor comprising:
  - an extractor trough defining a chamber comprising a lower region and an upper region;
  - a rotating element received within the extractor trough, the rotating element comprising:
    - a shaft; and
    - projections extending outwardly from the shaft and being removably secured thereto;
  - a motor system operatively coupled to the at least one rotating element for driving rotation thereof; and
  - a liquid outlet provided at an upstream end of the extractor trough for withdrawing a solvent diluted bitumen stream comprising bitumen, solvent and fine mineral solids; and
  - an oil sands feed inlet provided at the upstream end for supplying oil sands material into the primary extraction assembly;
  - wherein the rotation of the rotating element provides digestion and extraction of bitumen from the oil sands while advancing solids in a downstream direction, as the solvent diluted bitumen accumulates in the upper region of the extractor trough and flows in an upstream direction toward the liquid outlet;
- separating fine mineral solids from the solvent diluted bitumen stream to produce a solvent affected fine tailings stream and a bitumen enriched stream; and
- processing the bitumen enriched stream to produce a bitumen product.

In some implementations, the shaft has an edgeless cross-section and comprises elongated slots extending in circumferential arcs around the shaft, and a corresponding one of the projections is provided along a corresponding one of the elongated slots for being removably secured to the shaft.

In some implementations, adjacent ones of the elongated slots are provided in an offset configuration.

In some implementations, a first set of two elongated slots is provided in a spaced-apart relationship around a first circumferential arc of the shaft, a second set of two elongated slots is provided in a spaced-apart relationship around a second circumferential arc of the shaft, the first and second sets of the elongated slots being longitudinally spaced-apart from one another.

In some implementations, a first subcomponent of two projections is provided along the first set of two elongated slots and a second subcomponent of two projections is provided along the second set of two elongated slots, each one of the projections of the first and second subcomponents of projections extending in a given quadrant defined around the shaft.

In some implementations, a first subcomponent of two projections is provided along the first set of two elongated slots and a second subcomponent of two projections is provided along the second set of two elongated slots, each one of the projections of the first and second subcomponents of projections extending at an angle between about 45° and about 90° relative to each other.

In some implementations, the projections are removably secured to the shaft via a mounting assembly.

In some implementations, the mounting assembly is displaceable along the elongated slots to provide the projections in the offset configuration around the shaft.

In some implementations, the mounting assembly is configured to rotate about a transverse axis of the shaft to modify a positioning of the projections.

In some implementations, the mounting assembly is configured such that the corresponding one of the projections is oriented at an angle relative to a transverse plane extending perpendicularly to a longitudinal axis of the shaft.

In some implementations, the mounting assembly is configured such that the corresponding projection is oriented parallel relative to a transverse plane extending perpendicularly to a longitudinal axis of the shaft.

In some implementations, the mounting assembly comprises a bracket.

In some implementations, the projections are removably secured to the shaft via a mounting assembly, and the mounting assembly comprises a single mechanical fastener extending across the shaft to secure two opposite projections of the first subcomponent of two projections or of the second subcomponent of two projections together.

In some implementations, adjacent ones of the projections are provided in an offset configuration.

In some implementations, a first subcomponent of two projections is provided longitudinally adjacent to a second subcomponent of two projections, each one of the projections of the first and second subcomponents of projections extending in a given quadrant defined around the shaft.

In some implementations, a first subcomponent of two projections is provided longitudinally adjacent to a second subcomponent of two projections, each one of the projections of the first and second subcomponents of projections extending at an angle between about 45° and about 90° relative to each other.

In some implementations, the shaft has a polygonal profile.

In some implementations, the shaft has at least four edges and four outer surfaces in between.

In some implementations, the projections of the first and second subcomponents of projections extend outwardly from a corresponding one of the four outer surfaces of the shaft.

In some implementations, the projections of the first subcomponent of projections are provided offset from the projections of the second subcomponent of projections relative to a longitudinal axis of the shaft.

In some implementations, the shaft has an edgeless profile.

In some implementations, the shaft has a circular profile.

In some implementations, the projections of the first subcomponent of projections are provided offset from the projections of the second subcomponent of projections relative to a longitudinal axis of the shaft.

In some implementations, the shaft comprises at least one support member extending outwardly therefrom for supporting a corresponding one of the projections.

In some implementations, the at least one support member and the corresponding one of the projections are integral with each other.

In some implementations, the projections are removably secured to the shaft via a corresponding dovetail joint.

In some implementations, the rotating element further comprises a mounting assembly for removably securing a corresponding projection to the shaft.

In some implementations, the mounting assembly is configured such that the corresponding one of the projections is oriented at an angle relative to a transverse plane extending perpendicularly to a longitudinal axis of the shaft.

In some implementations, the mounting assembly is configured such that the corresponding one of the projections is oriented parallel relative to a transverse plane extending perpendicularly to a longitudinal axis of the shaft.

In some implementations, the mounting assembly comprises a shaft mounting plate for engagement with the shaft and a projection mounting plate for engagement with the corresponding projection.

In some implementations, the mounting assembly is configured to rotate about a transverse axis of the shaft to modify a positioning of the corresponding projection.

In some implementations, the corresponding one of the projections and the mounting assembly are integral with each other.

In some implementations, the projections are removably secured to the shaft via a mounting assembly, and the mounting assembly comprises a single mechanical fastener extending across the shaft to secure two opposite projections of the first subcomponent of two projections or of the second subcomponent of two projections together.

In some implementations, the shaft comprises a plurality of shaft segments.

In some implementations, the projections comprise sharpened edges to cut through the oil sands.

In accordance with another aspect, there is provided a method of servicing a rotating element as described herein, the method comprising:

removing and replacing at least one of the projections of the rotating element.

In accordance with another aspect, there is provided a method for manufacturing a non-aqueous extraction (NAE) extractor configured for extracting a solvent diluted a bitumen from an oil sands material, the method comprising:

providing an extractor trough;

mounting a rotating element into the extractor trough, comprising:

mounting a shaft into the extractor trough, the shaft being operatively couplable to a motor for driving rotation of the rotating element; and removably securing a plurality of projections to the shaft.

In some implementations, the projections are as described herein.

In accordance with another aspect, there is provided a method for manufacturing a non-aqueous extraction (NAE)

extractor configured for extracting a solvent diluted a bitumen from an oil sands material, the method comprising:

providing an extractor trough;

mounting a rotating element into the extractor trough, comprising:

mounting a shaft into the extractor trough, the shaft being operatively couplable to a motor for driving rotation of the rotating element;

inserting a shaft receiving hub of a shaft mounting structure over the shaft; and removably securing projections to the shaft receiving hub.

In some implementations, the projections are as described herein.

In accordance with another aspect, there is provided a rotating element receivable within an extractor trough of an extractor configured for non-aqueous extraction of bitumen from oil sands, the rotating element comprising:

a shaft mounting structure couplable to a shaft, comprising:

a shaft receiving hub having a shaft receiving hub profile and being configured for receiving the shaft therein; and projections extending outwardly from the shaft and being removably secured thereto via the shaft receiving hub, the projections being provided so as to extend at angle between −45° and +45° relative to a longitudinal plane extending along a longitudinal axis of the shaft;

wherein the rotation of rotating element provides digestion and extraction of bitumen from the oil sands while advancing solids in a downstream direction within the extractor trough, as solvent diluted bitumen accumulates in an upper region of the extractor trough and flows in an upstream direction toward a liquid outlet.

In some implementations, the shaft mounting structure comprises at least one support member extending outwardly therefrom for supporting a corresponding one of the projections.

In some implementations, the at least one support member and the corresponding one of the projections are integral with each other.

In some implementations, the corresponding one of the projections is in contact the shaft receiving hub.

In some implementations, the corresponding one of the projections is spaced-apart from the shaft receiving hub, and the at least one support member is in contact with the shaft receiving hub.

In some implementations, the shaft mounting structure comprises a plurality of shaft mounting structures each having a corresponding shaft receiving hub.

In some implementations, corresponding shaft receiving hubs is connected to at least two projections.

In some implementations, each one of the corresponding shaft receiving hubs is connected to four projections.

In some implementations, the projections are provided so as to extend parallel relative to a longitudinal plane extending along the longitudinal axis of the shaft.

In some implementations, the projections have a front facing surface having a curved profile when viewed along the longitudinal axis of the shaft.

In accordance with another aspect, there is provided a rotating element receivable within an extractor trough of an extractor configured for non-aqueous extraction of bitumen from oil sands, the rotating element comprising:

a shaft operatively couplable to a motor configured for driving a rotation of the shaft;

mounting assemblies each comprising a curved slot configured to receive an engagement device therein; and a projection provided integral with a corresponding one of the mounting assemblies, the projection extending outwardly from the shaft and being removably secured thereto via the corresponding one of the mounting assemblies, wherein the angle of the projection is determined by a location of the engagement device along the curved slot;

wherein the rotation of rotating element provides digestion and extraction of bitumen from the oil sands while advancing solids in a downstream direction within the extractor trough, as solvent diluted bitumen accumulates in an upper region of the extractor trough and flows in an upstream direction toward a liquid outlet.

In some implementations, the corresponding one of the mounting assemblies is configured such that the projection is oriented at an angle relative to a transverse plane extending perpendicularly to a longitudinal axis of the shaft.

In some implementations, the corresponding one of the mounting assemblies is configured such that the projection is oriented parallel relative to a transverse plane extending perpendicularly to a longitudinal axis of the shaft.

In some implementations, the engagement device comprises a bolt and a nut.

In accordance with another aspect, there is provided an extraction assembly for non-aqueous extraction of bitumen from oil sands, the extraction assembly comprising:

an extractor trough comprising a liquid outlet in an upstream region thereof; and a rotating element receivable within the extractor trough, the rotating element comprising:

a shaft operatively couplable to a motor configured for driving a rotation of the shaft;

a shaft mounting structure couplable to the shaft, comprising:

a shaft receiving hub having a shaft receiving hub profile and being configured for receiving the shaft therein; and projections extending outwardly from the shaft and being removably secured thereto via the shaft receiving hub;

wherein rotation of the rotating element provides digestion and extraction of bitumen from the oil sands while advancing solids in a downstream direction within the extractor trough, as solvent diluted bitumen accumulates in an upper region of the extractor trough and flows in an upstream direction toward the liquid outlet.

In some implementations, the projections are integral with the shaft receiving hub.

In some implementations, the shaft mounting structure further comprises a mounting assembly for removably engaging a corresponding one of the projections with the shaft receiving hub.

In some implementations, the mounting assembly comprises a single mechanical fastener extending across the shaft receiving hub and the shaft to secure two opposite projections together.

In some implementations, the rotating element comprises at least two rotating elements receivable within the extractor trough and provided side-by-side relative to each other.

In some implementations, the shaft mounting structure comprises a plurality of shaft mounting structures mounted in series onto the shaft and each having a corresponding shaft receiving hub.

In some implementations, the plurality of shaft mounting structures are configured such that adjacent shaft receiving hubs interlock with each other.

In some implementations, the rotating element further comprises a retaining member at each end to retain the plurality of shaft mounting structures onto the shaft.

In some implementations, the shaft receiving hub profile is an edgeless profile.

In some implementations, the shaft receiving hub profile is a polygonal profile.

In some implementations, the shaft receiving hub profile includes four outer surfaces, with a corresponding projection of a set of four of the projections extend outwardly from a corresponding one of the four outer surfaces of the shaft receiving hub.

In some implementations, the projections extend at angle between −45° and +45° relative to a longitudinal plane extending along a longitudinal axis of the shaft.

In some implementations, the shaft mounting structure further comprises at least one support member extending outwardly therefrom for supporting a corresponding one of the projections.

In some implementations, the at least one support member and the corresponding one of the projections are integral with each other.

In some implementations, the projections are removably secured to the shaft receiving hub via a corresponding dovetail joint.

In some implementations, the projections have a front facing surface having a curved profile when viewed along the longitudinal axis of the shaft.

In accordance with another aspect, there is provided a projection assembly for a rotating element placeable within an extractor trough of an extractor, the projection assembly comprising:

a shaft mounting structure couplable to a shaft, comprising:

a shaft receiving hub having a shaft receiving hub profile and being configured for receiving the shaft therein; and projections extending outwardly from the shaft and being removably secured thereto via the shaft receiving hub, wherein rotation of the projection assembly enables contact of the projections with a slurry receivable in the extractor trough to move the slurry in a downstream direction along the extractor trough.

In some implementations, the projections are integral with the shaft receiving hub.

In some implementations, the shaft mounting structure further comprises a mounting assembly for removably engaging a corresponding one of the projections with the shaft receiving hub.

In some implementations, the mounting assembly comprises a single mechanical fastener extending across the shaft receiving hub and the shaft to secure two opposite projections together.

In some implementations, the shaft mounting structure comprises a plurality of shaft mounting structures mountable in series onto the shaft and each having a corresponding shaft receiving hub.

In some implementations, the plurality of shaft mounting structures are configured such that adjacent shaft receiving hubs interlock with each other.

In some implementations, the shaft receiving hub profile includes four outer surfaces, with a corresponding projection of a set of four of the projections extend outwardly from a corresponding one of the four outer surfaces of the shaft receiving hub.

Several innovative process aspects and configurations are described herein for NAE and separation of bitumen from oil sands and other bitumen-containing materials.

DETAILED DESCRIPTION

Techniques described herein leverage the use of a hydrocarbon solvent to extract bitumen from mined oil sands and employ an extractor that includes rotating elements having enhanced design features. For instance, the extractor can include a trough along which two side-by-side rotatable shafts extend with each shaft having projections that can be removably mounted to the corresponding shaft and configured for mixing and advancing a bed of oil sands ore and solvent as the shafts are rotated. The projections and shafts can have various features to facilitate the processing of oil sands ore. Overall process features as well as implementations of the extractor will be described in further detail below.

Non-aqueous extraction (NAE) of bitumen can be carried out using a low boiling point organic solvent that has a high solubility for bitumen and allows easy separation from the bitumen after extraction. The solvent containing stream added to the oil sands for extraction can include both solvent as well as bitumen or bitumen derived materials, and can be referred to as "solbit". It is also noted that the term "solbit" can be used in the context of other streams and zones present in vessels that include a mixture of solvent and bitumen. The solid mineral materials from which bitumen is extracted can be disposed readily into a mine pit as reclamation material, thereby facilitating mine reclamation and significantly reducing tailings management requirements.

Non-aqueous extraction of bitumen with hydrocarbon solvents has potential for processing a broad range of oil sands ore qualities (e.g., 5 wt %-13 wt % bitumen), producing dry trafficable tailings material with less land disturbance, and lowering green house gas (GHG) emissions per barrel of bitumen compared to aqueous extraction techniques.

Various enhancements related to extraction units for extracting bitumen in presence of solvent in the context of non-aqueous extraction processes are described herein.

General Overview of a Non-Aqueous Extraction Process

Figure 1:
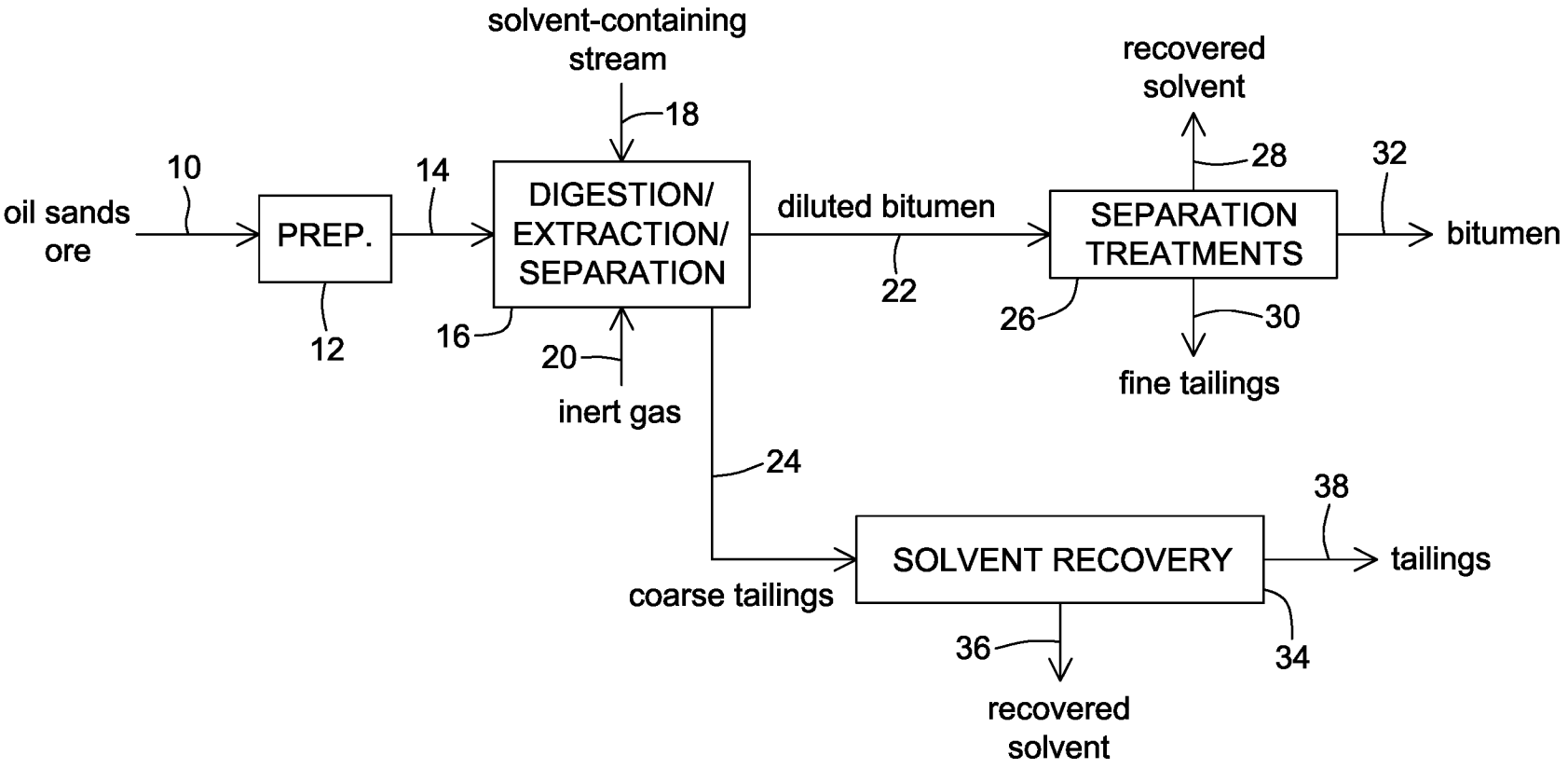
FIG. 1 is a block diagram of a process for extracting bitumen from oil sands.

Referring to FIG. 1, a non-aqueous extraction process can include mining oil sands ore 10 and subjecting the ore to a preparation stage 12 prior to subsequent extraction of bitumen. The preparation 12 can include crushing, sizing, and pre-treating to produce a sized ore material 14 that can be introduced into a non-aqueous extraction stage 16 where a hydrocarbon solvent facilitates extraction of the bitumen from the mineral solids that make up the oil sands ore. Regarding the extraction stage 16, it can be an integrated stage that enables multiple features including digestion of the ore, extraction of the bitumen from the mineral solids, and separation of the solvent and bitumen from the mineral solids. In some implementations, this extraction stage 16 can be referred to as a digestion/extraction/separation stage that is implemented by in a single unit, although it should be noted that other implementations of the process may enable the operations of digestion, extraction and separation in multiple distinct units.

A solvent-containing stream 18 is supplied to the extraction stage 16 to dilute the bitumen and promote extracting and separation of the bitumen from the mineral solids. The solvent-containing stream 18 can include a hydrocarbon solvent that is selected to be more volatile than the bitumen to facilitate downstream separation and recovery of the solvent. The solvent-containing stream 18 can be derived from one or more downstream unit and can include a predominant portion of solvent and a minor portion of bitumen (generally referred to as "solbit", which will be discussed further below). The solvent-containing stream 18 can be a combination of several downstream fluids that include different proportions of solvent.

An inert gas 20 is also delivered to the extraction stage and associated units to displace any oxygen or maintain pressure to prevent in-leakage.

The extraction stage 16 produces solvent diluted bitumen 22 and solvent diluted coarse tailings 24. The solvent diluted bitumen 22 is subjected to additional separation treatments 26 including solvent recovery to obtain recovered solvent 28 for reuse in the process, fine tailings 30 composed mainly of fine particular mineral solids less than 44 microns as well as residual solvent and bitumen, and bitumen 32. The bitumen 32 can include some solvent and residual contaminants, and can be subjected to further processing, such as deasphalting and refining.

Still referring to FIG. 1, the solvent diluted coarse tailings 24 are subjected to further treatments, such as solvent recovery 34 to produce recovered solvent 36 and solvent depleted tailings 38.

Figure 2:
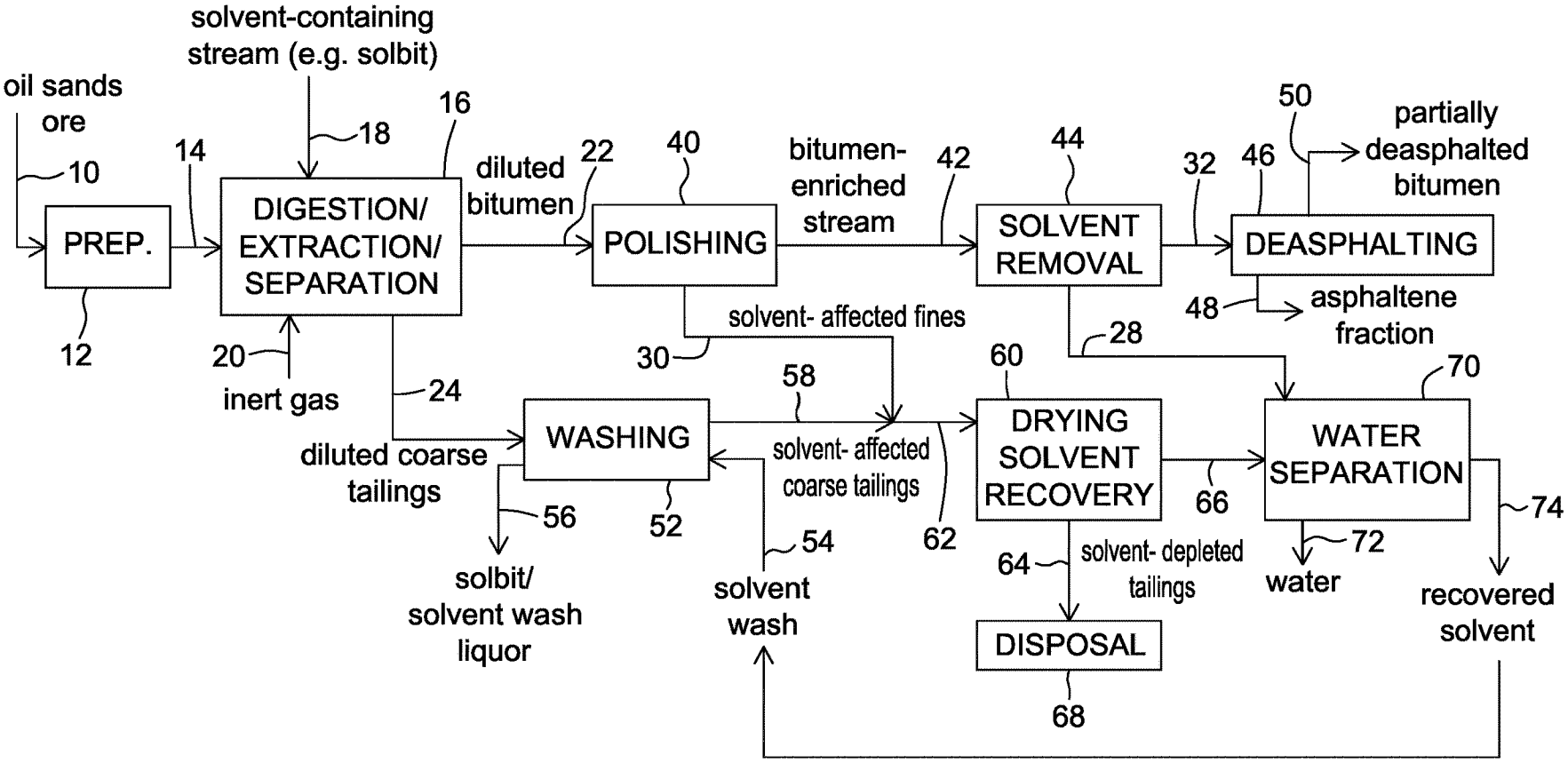
FIG. 2 is another block diagram of an example process for extracting bitumen from oil sands.

Referring now to FIG. 2, more details regarding the treatment of the diluted bitumen 22 and the diluted coarse tailings will be described. The diluted bitumen 22, which includes solvent and fines, can be first subjected to polishing 40 to separate solvent affected fine tailings 30 from a bitumen enriched, solids depleted stream 42. The solvent affected fine tailings 30 can be treated to remove solvent, which can be done in conjunction with the solvent recovery from the coarse tailings 24. The polishing 40 can be performed using a centrifuge, for example. The bitumen enriched stream 42 can be subjected to solvent removal 44 to produce the recovered solvent 28 and bitumen 32, which can be further processed by solvent deasphalting 46 to produce an asphaltene fraction 48 and a partially deasphalted bitumen 50.

Still referring to FIG. 2, the solvent diluted coarse tailings 24 can be subjected to washing 52 where solvent wash 54 is added to the tailings in order to remove residual bitumen from the tailings and produce a solvent-bitumen mixture 56 (which can also be referred to as "solbit") and solvent affected coarse tailings 58. The solvent wash 54 can be fresh or relatively pure or commercial grade solvent to promote cleaning of residual bitumen from the tailings. The solbit 56 that is produced by the washing 52 can be used as the sole or main source of solvent for the extraction stage 16.

The solvent affected coarse tailings 58 can then be subjected to further processing for solvent recovery, which may include a drying stage 60. The drying stage 60 can receive the solvent affected coarse tailings 58 as well as the solvent affected fine tailings 30, which in certain cases, can be introduced as a single solvent affected tailings stream 62 into the drying solvent recovery stage 60. Separate processing of such tailings streams is also possible. The drying solvent recovery stage 60 produces recovered solvent 66 and solvent depleted tailings 64, which can be sent for disposal 68, for example as mine pit fill.

Referring still to FIG. 2, the recovered solvent streams 28, 66, which are obtained from the fine and coarse tailings streams respectively, can be subjected to a water separation stage 70 in order to remove residual water 72 from the solvent 74. This water can originate from connate water present in the mined oil sands ore or from surface waters (e.g., rain, snow, ice) incidentally introduced in the course of oil sand mining operations.

The solvent containing stream 18 that is supplied to the extraction stage 16 can include several solbit components, including solvent wash liquor 56 from the washing stage 52, solvent permeate/drainage from solvent affected tailings streams 30 and/or 58, as well as solvent make-up. The solvent affected tailings streams 30, 58 can be deposited on a filter or within another type of vessel or drainage unit from which a solvent rich liquid can drain to form a solvent permeate/drainage stream as a solbit component. Solvent make-up can also be added to form part of the solvent containing stream 18. It should be noted that composition characteristics (e.g., bitumen content, solvent content, solvent-to-bitumen ratio) can be monitored for the various solbit components (e.g., wash liquor 56, tailings drainage) and the components can be combined together in order to obtain desired properties for the solvent containing stream 18.

In addition, other solvent processing steps can be undertaken to produce the recovered solvent 74 that can be recycled back into other parts of the process, such as the washing stage 52. Solvent make-up can be added to the recovered solvent 74 to form the solvent wash 54, for example.

It should be noted that various other solvent supply, recovery and processing techniques that have not been described or illustrated in FIG. 2 can be implemented. For example, solbit components can be recovered from various unit operations downstream of the extraction stage and they can be reused as a single solvent containing stream that is fed into the extraction stage or as multiple feed streams. In addition, according to some alternative implementations, fresh solvent can be used directly in the extraction stage and in other units of the process. Regarding solvent addition techniques, one may refer to different feed inlet approaches as single point feed, intermediate feed, or cascade feeds.

Various parts of the overall process—including ore preparation, extraction, diluted bitumen processing and tailings processing—will now be discussed in more detail.

Oil Sands Ore Preparation

Referring to FIG. 1, the mined oil sands ore 10 can be subjected to various preparation treatments in advance of the digestion, extraction and separation. The preparation treatments can include crushing and sizing.

In some implementations, the mined oil sands ore 10 can be supplied to a crushing unit to produce crushed ore, and the crushed ore can be fed to a sizing stage. The sizing stage can include one or more units that convert the crushed ore into a more uniform and smaller sized feed material for downstream processing. The sizing can be done as dry sizing (i.e., with little to no added liquid) or wet sizing (i.e., with some added hydrocarbon liquid selected for compatibility with downstream processing and safety considerations). The sized oil sands material 14 can then be fed into a hopper 90 prior to being supplied to downstream processing.

In terms of the size of the oil sands lumps in the sized oil sands material 14, for a non-aqueous extraction process the target maximum size of the lumps can be 2 inches, 1.5 inches or 1 inch, for example. This smaller size limit can be viewed in contrast with hot water extraction (HWE) methods of oil sands processing where the sized ore lumps can be up to 4 inches. The smaller lump size in the sized oil sands material 14 can provide advantages in terms of faster digestion and extraction, particularly when the sized oil sands material 14 is fed directly to an extraction unit that includes integrated digestion. However, it is noted that in some implementations the target maximum size of the oil sands lumps can be 4 inches or 3 inches, for example.

It is also noted that the oil sands material can be contacted with a small amount of solvent prior to introduction into the extraction unit. This can be viewed as a solvent moistening pre-treatment of the oil sands material, which enables the solvent to begin to penetrate and mingle with the bitumen in the pores of the oil sands, and thus facilitate digestion as lumps become easier to break down. A solvent containing stream can be sprinkled or sprayed onto the oil sands material, and can be formulated to have a composition to minimize vaporization of the solvent (e.g., higher bitumen content in the solvent stream). The pre-moistening can be done in various units upstream of the extractor and such units would be sealed and inerted. For example, the solvent could be added into a holding vessel and/or a conveyor. These units would also be connected to a vapour recovery and management system, which could also be connected to other units in the overall process. The addition of solvent can also increase the pressure within the sealed vessel or conveyor or other upstream unit, which can also reduce air ingress. The solvent that is added for pre-moistening can be part of a solbit stream that is formulated for that particular purpose and/or may include hydrocarbon fractions generated in downstream bitumen processing operations. For instance, this solbit stream can have higher bitumen content. The solbit stream can be formulated to have particular fluid dynamic properties for spraying via a particular nozzle configuration to achieve a desired spray pattern.

Digestion, Extraction and Separation

As will be explained in this section, there are a number of different process configurations and equipment designs that can be used to perform the digestion, extraction and separation operations. Before describing particular process and system implementations, general comments regarding digestion, extraction and separation will be described below.

"Digestion" can be considered to involve disintegrating the lumps in the sized oil sands material to smaller and smaller sizes using shear based means or a combination of mechanical, fluid, thermal, and chemical energy inputs, with the aim of providing a digested material where the lumps are reduced to individual grains that are coated with bitumen. Breaking down the adherence between the solid mineral grains can involve shearing with dynamic or static mixer devices and/or mobilization of interstitial bitumen using heat or solvent dissolution.

"Extraction" can be considered to involve dissociating bitumen from the mineral solids to which the bitumen is adhered. Bitumen is present in the interstices between the mineral solid particles and as a coating around particles. Extraction entails reducing the adherence of the bitumen to the solid mineral materials so that the bitumen is no longer intimately associated with the minerals. Effective digestion enhances extraction since more of the bitumen is exposed to extraction conditions, such as heat that mobilizes the bitumen and solvent that dissolves and mobilizes the bitumen. Effective extraction, in turn, aims to enhance separation performance in terms of maximizing recovery of bitumen from the oil sands ore and minimizing the bitumen that reports to the tailings. In commercial implementations, the target extraction level is typically at least 90 wt % of the bitumen present in the oil sands material, although other extraction levels or thresholds can be used.

"Separation" in this context can be considered to involve removing the extracted bitumen from the mineral solids, forming a distinct stream or material that is enriched in bitumen and depleted in solid mineral material. Separation mechanisms can include gravity separation in which density differences cause lighter solvent diluted bitumen to rise while heavier solid mineral material sinks within a vessel. In separation, there is a displacement of bitumen enriched, solids depleted material away from bitumen depleted, solids enriched material. In the context of FIG. 1, for example, the separation results in the production of the solvent diluted bitumen 22 and the solvent diluted coarse tailings 24. Solbit tends to have a low density and viscosity compared to water based separation methods, which are enhanced attributes for separation.

While digestion, extraction and separation are described above as distinct phenomena, they can of course occur to some degree simultaneously within a given vessel or unit.

Counter-Current Flow Extractor Implementations

An example implementation of a NAE process will now be described with reference to FIG. 3. In the illustrated implementation, oil sands ore 10 is subjected to crushing 80 and sizing, and the sized oil sands ore 14 is fed into an integrated extractor 1000 that includes rotating elements. The extractor 1000 is provided with a purge line 1002 and a vapour exit line 1004. The sized oil sands 14 is fed via a feed line 1006 that is provided at an upstream end of the extractor 1000. In this implementation, the extractor 1000 is operated with a counter-current displacement of the solids relative to the solbit, with the solids moving downstream while the solbit is moving upstream. The extractor 1000 produces a solvent diluted bitumen stream 1008 that can be withdrawn from its upstream end and supplied into a surge tank, and a solvent diluted tailings stream 1012 that can be discharged from a downstream end into a coarse solids pump box. It is noted that one or more hydrocyclones can be added to separate fines from the extractor tailings 1012 and/or from the solbit and/or from other slurries in the process, so as to process fines separately from the coarse tailings.

The solvent diluted bitumen stream 1008 can be supplied to a gravity separator 1018 to remove fine solids. The gravity separator 1018 can be an inclined plate separator that includes inclined plates 1020 provided in an upper portion of the separator and a conical section in a bottom portion thereof. It is noted that various other types of separators could be implemented instead of a gravity separator at this stage of the process to remove a portion of the fines from the solvent diluted bitumen stream 1008. The gravity separator 1018 produces an overflow stream 1022 that includes mainly bitumen and solvent with some residual fines, and an underflow solvent diluted fines stream 1024. This separation stage can also be referred to as a bulk fines separation stage where most of the fines in the solvent diluted bitumen stream 1008 are removed.

Figure 3:
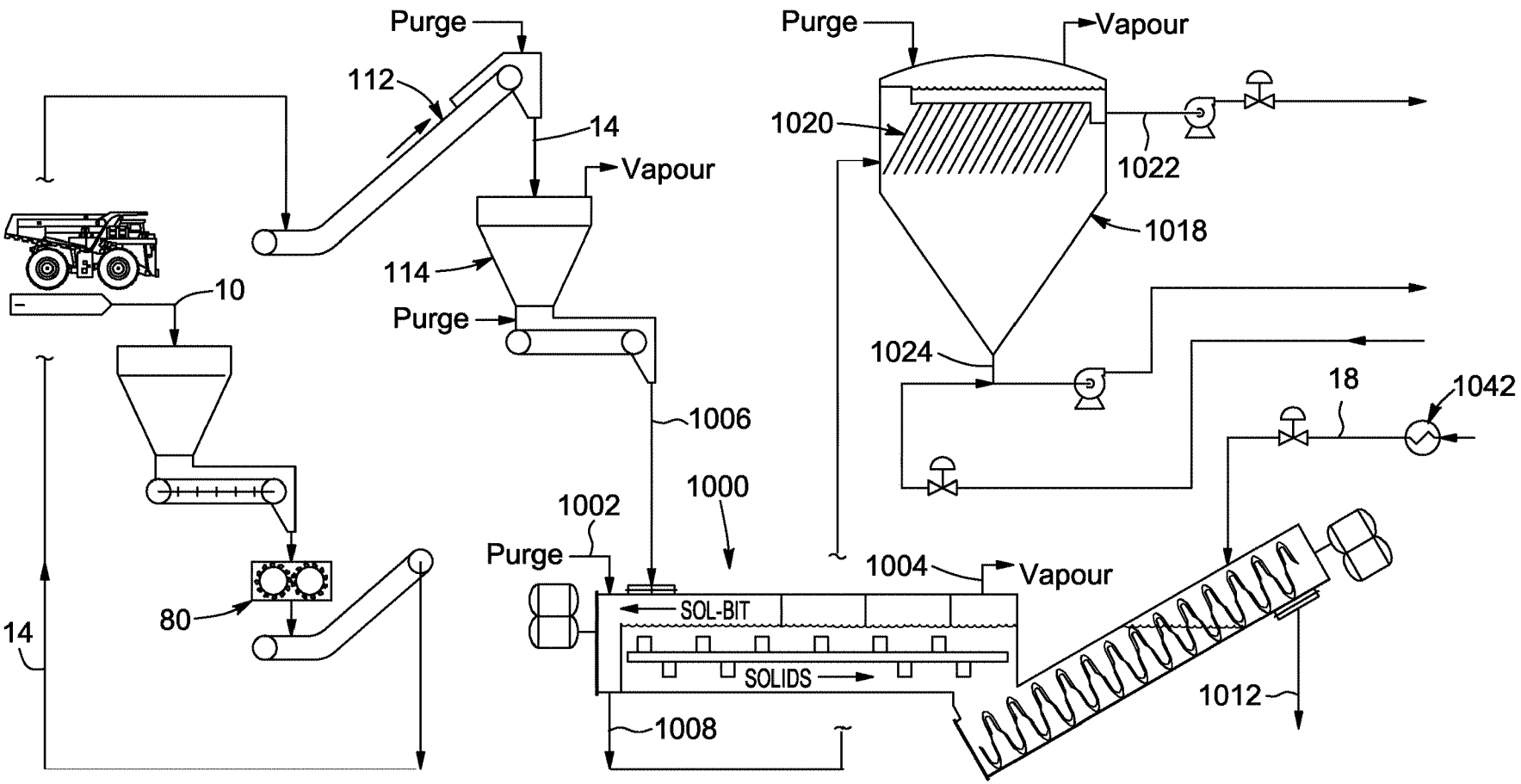
FIG. 3 illustrates a flow diagram of a process implementation for extracting bitumen from oil sands.

Referring still to FIG. 3, the overflow stream 1022 from the gravity separator can be supplied to a second fines separation stage, which may be conducted for instance in a centrifuge, to remove additional fines from the solvent diluted bitumen and produce the bitumen enriched, solids depleted stream 42 which is then supplied to solvent recovery.

Thus, the solvent diluted bitumen stream 1008 produced by the extractor 1000 can be subjected to fines removal, which can be conducted in multiple stages. The first stage of fines removal can be performed by gravity, while the second stage of fines removal can be performed by accelerated techniques, such as centrifuging.

The various solids rich tailings streams can be supplied to a washing unit for washing and filtration to remove residual bitumen and drain solvent from the mineral solids. The washing unit produces a washed tailings that can be supplied by conveyor to a drum dryer or another type of solvent recovery unit. The washing unit also receives fresh solvent or a relatively high solvent content stream, and produces a solvent wash liquor. The fresh solvent can be obtained from a solvent recovery unit and may be pre-cooled in a cooler prior to being fed to the washing unit.

The solvent wash liquor can be withdrawn from the washing unit at several different locations, and each of the withdrawn streams can have different compositions in terms of solvent and bitumen content. It should be noted that other solvent containing streams can also be fed into the solvent wash liquor stream and/or added directly to the extractor depending on solvent demand and operating conditions. The solvent wash liquor is a solvent rich solbit stream that can be supplied to other parts of the process. For example, the solvent wash liquor can be supplied, at least in part, to the downstream end of the extractor as the sole source of solvent or a part of that source. Some of the solvent wash liquor can also be recycled to other units to increase fluidity of solids rich streams or for other purposes.

In the implementation shown in FIGS. 3 to 11, the counter-current extractor 142 includes a horizontal primary extraction section 420 followed by an inclined classifier section 418. However, the extractor design could be modified in various ways. For example, the extractor could include one main section that is inclined and has an upstream section where the shafts of the rotating elements are below the liquid level and a downstream section where the shafts of the rotating elements extend above the liquid level to enable back drainage. Thus, the entire unit can be configured to be inclined at a single angle (which can be adjustable), or multiple sections of the unit can have different angles (e.g., horizontal followed by inclined, or various sections having different angles to provide the desired mixing and transportation functions along the length of the unit).

Figure 4:
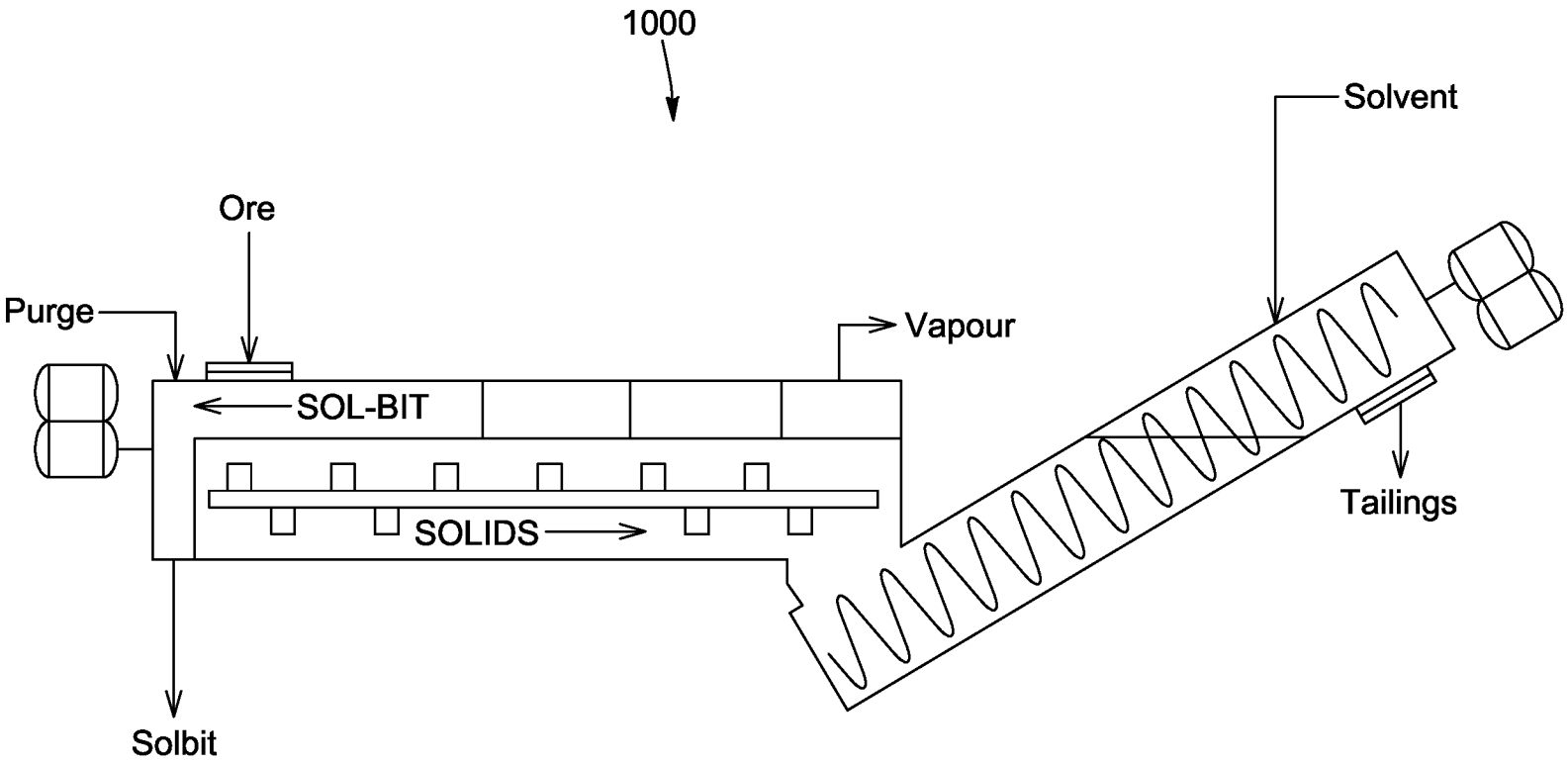
FIG. 4 is an example of an extraction assembly for extracting bitumen from oil sands.

One factor to consider in designing the counter-current extractor is to balance the mixing and transportation functions along the length of the unit. One challenge of operating a counter-current extractor configured as a single inclined unit is that there is typically only one pair of rotating elements. In the two-section design as shown in FIGS. 3 and 4, the primary extraction assembly 420 can rotate at relatively high speeds to provide enough mechanical energy to the ore to mix with the solvent for good extraction while in the classifier assembly 418, the augers can rotate at lower speeds. When comparing equipment of the same size, augers generally run at lower speeds than rotating elements having discrete projections, such as log washers, to transport the same amount of ore. Having an independent pair of motors in the two-section design enables the rotating elements of the primary extraction assembly 420 to be run at higher speeds while the classifier augers of the classifier assembly 418 are run at lower speeds, and they can both be adjusted independently. Thus, the two-section extractor design provides certain enhancements and operational flexibility compared to the single-unit design.

Additional features may be included in some implementations of the extractor 1000. For example, the extractor trough 482 may include baffles or weirs to control the amount of mixing in the expanded fluidized bed (containing the solids) and the overlying solvent stream (containing the bitumen) that is passing in the opposite direction to the solids. One or more mechanical inserts such as horizontal baffles or weirs may be included between the solid rich zone in the lower part of the extractor trough 482 and the overlying solvent rich zone in the upper part of the extractor trough 482, parallel to the longitudinal flow of solvent, to reduce solids transfer between the expanded fluidized bed below and the liquid phase above. Alternatively, or in addition, one or more vertical baffles or weirs may extend from the upper part of the extractor trough 482 into the solvent rich zone, transverse to the flow of solvent, to control axial mixing in the solvent-rich zone.

Referring to FIGS. 5 to 11, the extraction unit 142 will now be described in further detail. The extraction unit 142 includes at least two conveyors in series, each conveyor comprising rotating assemblies and being connected to one another for facilitating digestion, extraction and separation functionalities. The first upstream conveyor can be generally horizontal and be configured as a primary extraction assembly 420, while the second downstream conveyor 418 can be upwardly inclined and configured as a classifier type unit with augers to separate and wash the solids. The primary extraction assembly 420 can be configured to receive oil sands ore and provide digestion and extraction as well as downstream transport of the solids via rotation of the rotating elements, and the classifier assembly 418 can be configured to receive the solids from the primary extraction assembly and provide transport out of the solbit and back drainage of the solbit to produce a bitumen depleted tailings material. The extraction unit 142 can be configured for counter-current operation, whereby solids are conveyed in a first direction, i.e., downstream, via the conveyors, and solvent is introduced into the extractor such that it flows in a second direction, i.e., upstream, substantially opposite to the first direction, in order to remove bitumen from the solids. For example, the conveyors can be disposed in relation to one another in a manner such that an angle is defined there between, which would typically involve orienting the primary extraction assembly 420 horizontally and orienting the classifier assembly 418 with an upward incline. Positioning the classifier assembly 418 at an angle with respect to the primary extraction assembly 420 can facilitates washing of the solids and gravity separation of the solbit from the solids.

Conveyors of this type of extractor can take various forms. For example, each conveyor can include a housing that accommodates at least one shaft from which mixing and advancing elements extend within the housing. For example, each conveyor can be an auger type conveyor, which include a rotating helicoidal screw blade, or a rotating conveyor that includes a shaft having rods, baffles, blades, flights, and/or paddles (or a combination thereof) that are oriented and configured to provide mixing energy to the oil sands and to advance solids downstream. In some implementations, both the primary extraction assembly 420 and the classifier assembly 418 have respective rotating elements that rotate about the longitudinal axis of the assemblies in order to provide mixing energy and transport the solids. In one example that will be described in detail below, the primary extraction assembly 420 includes at least one rotating element that rotates about its longitudinal axis and is configured as a "log washer" that includes a longitudinal shaft and elements extending outwardly from the shaft to provide high mixing energy while advancing the solids to facilitate digestion and extraction, while the classifier assembly 418 includes at least one auger that receives the solids advanced by the log washer and transports the solids upward to enable back drainage and washing of the solids prior to discharge as a tailings material.

The rotating elements of the primary extraction assembly 420 and the classifier assembly can have various designs, operations and corresponding functions. In some implementations, the rotating elements of the two assemblies have different designs to provide different functions. For example, the rotating elements of the primary extraction assembly 420 can be configured and operated to provide relatively high mixing energy to the solid rich material while slowly advancing the material downstream, whereas the rotating elements of the classifier assembly 418 can be configured to provide lower mixing energy while advancing solids downstream. In such configurations, the rotating elements of the primary extraction assembly 420 focus on mixing while the rotating elements of the classifier assembly 418 focus on transport.

Figure 5:
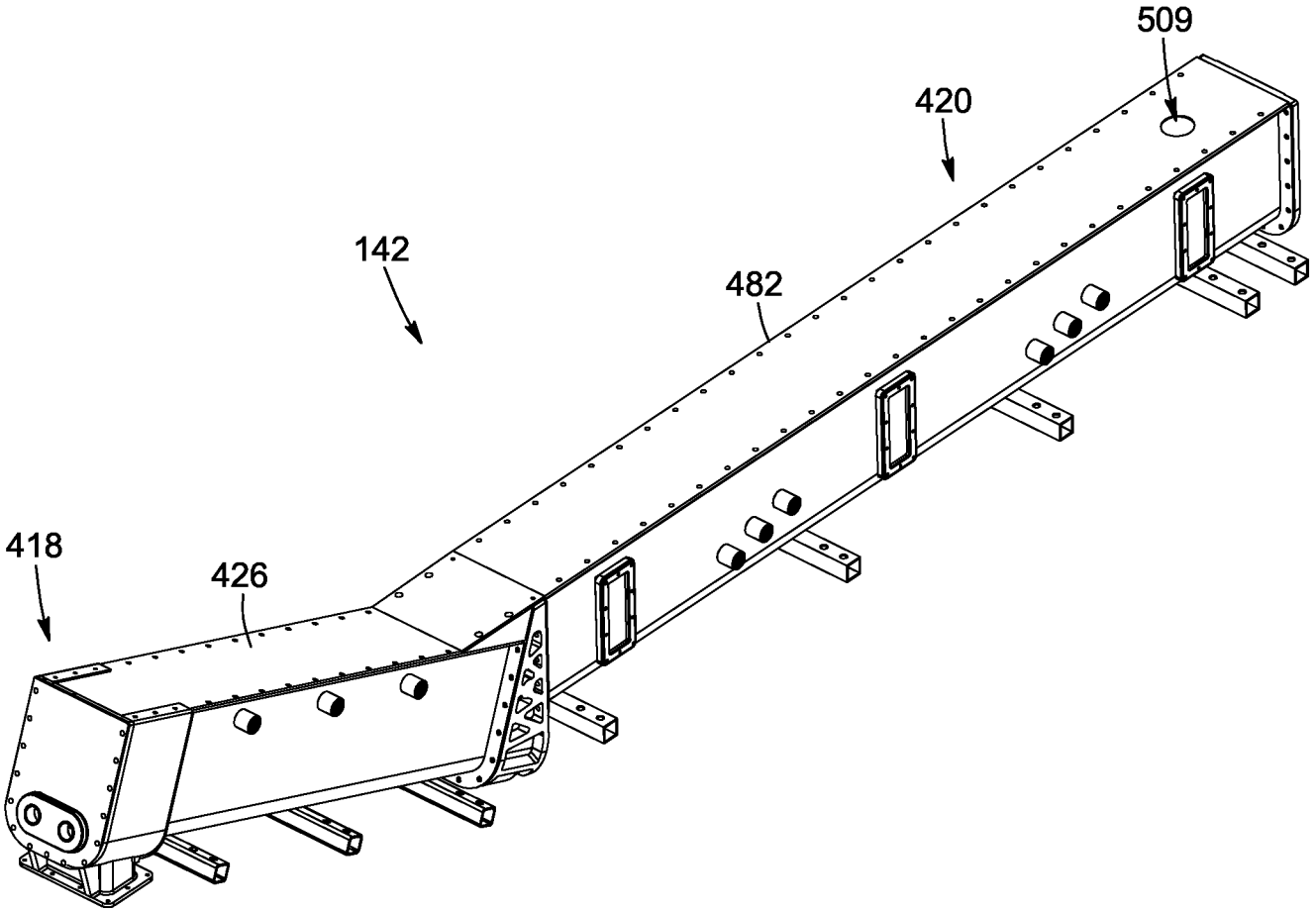
FIGS. 5 to 11 illustrate various parts of an extractor that includes a primary extraction assembly having rotating elements that are arranged longitudinally along an extraction trough and which can be operated with counter-current movement of solbit and solids.
Figure 6:
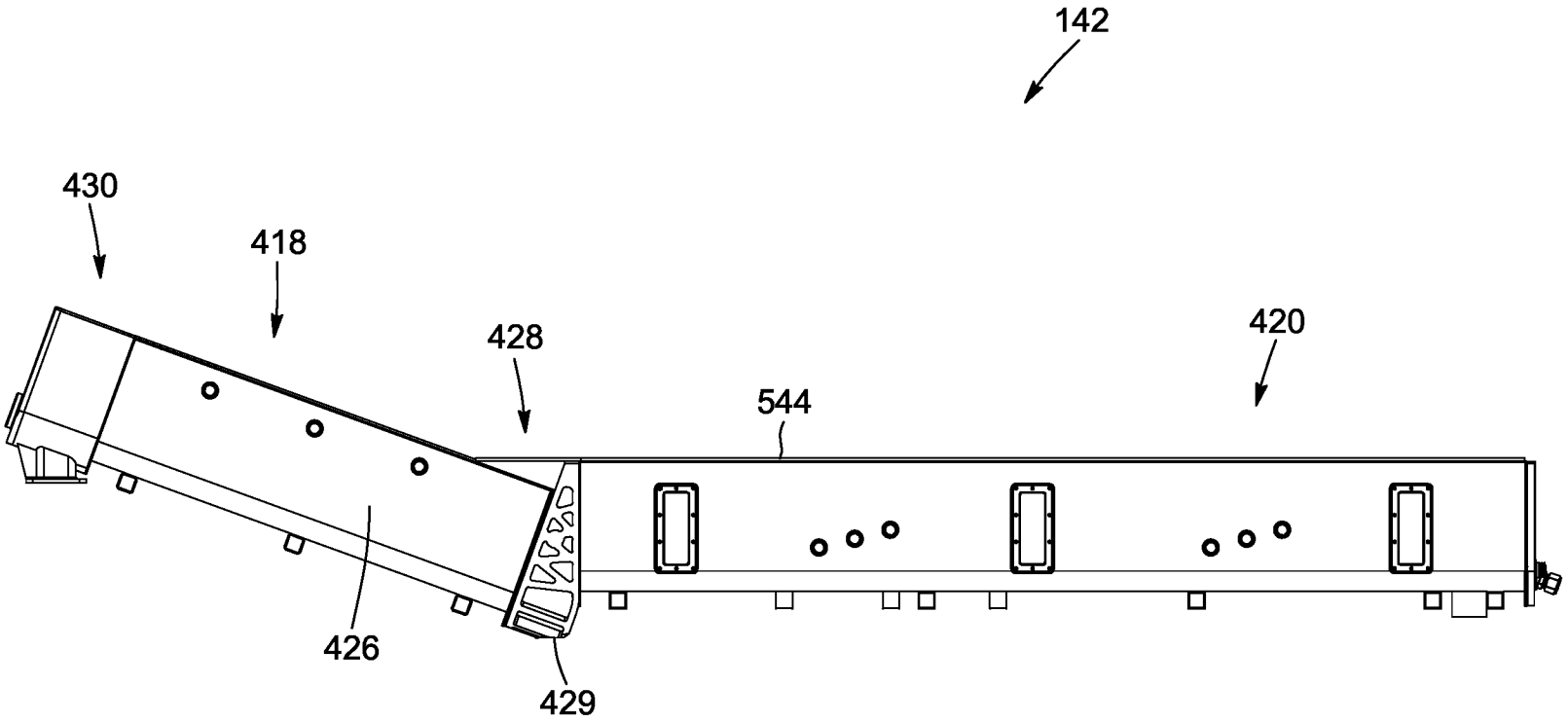
Figure 7:
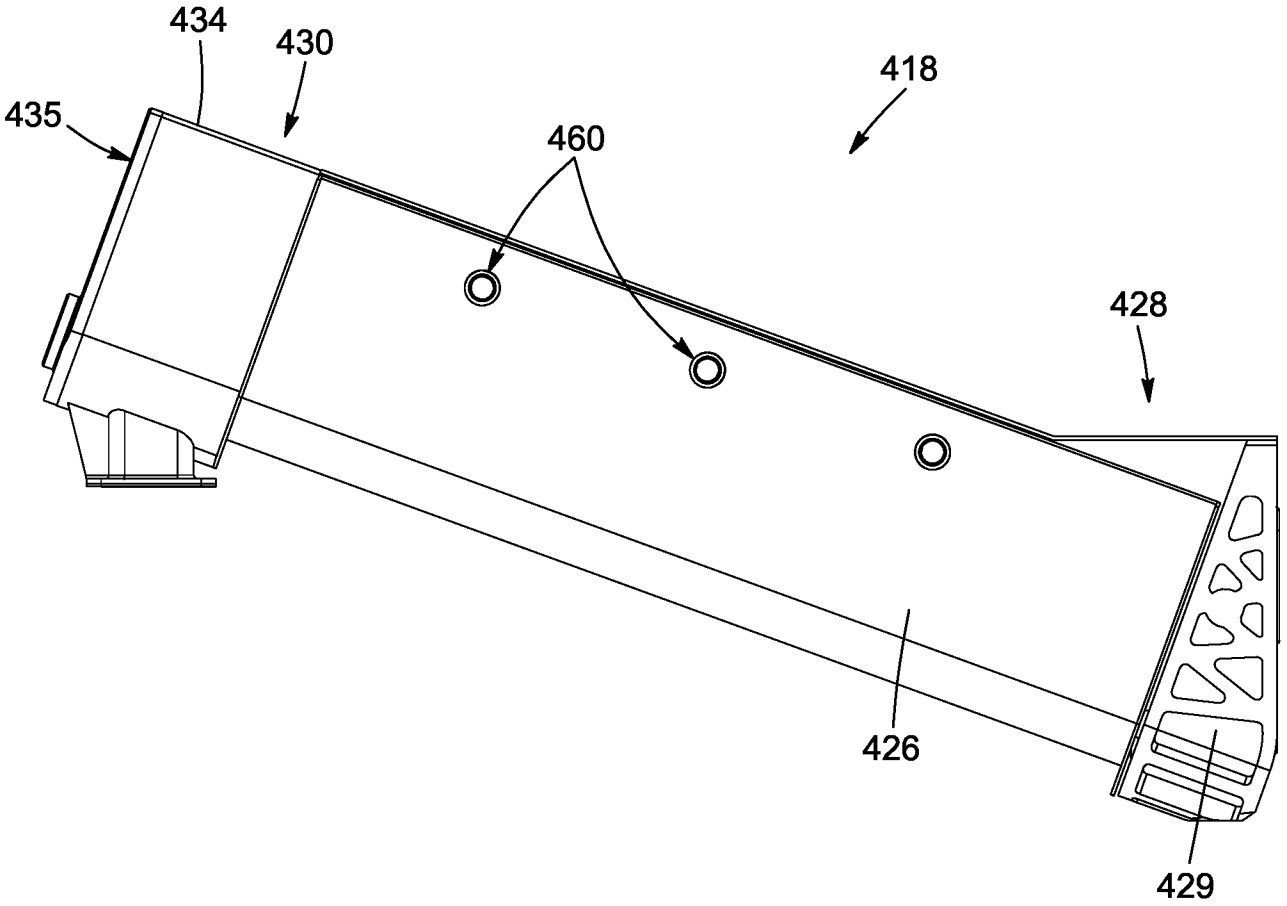

Referring to FIGS. 5 and 6, an implementation of an extractor 142 is shown, where an upstream extraction section is coupled to a downstream inclined classifier section. The upstream extraction section can also be referred to as the primary extraction assembly 420, and the downstream classifier section can also be referred to as the classifier assembly 418. The overall extractor 142 has digestion, extraction and separation functionality and can also enable some washing. The oil sands material can be fed into the upstream end of the primary extraction assembly 420 while the solvent containing stream can be fed into the classifier assembly 418 (e.g., at its downstream end) to enable counter-current movement of the oil sands and solids vis-a-vis the solvent and solbit liquid. The extractor 142 further includes a motor assembly adapted to operate the rotating elements of the corresponding primary extraction assembly 420 and classifier assembly 418.

Figure 8:
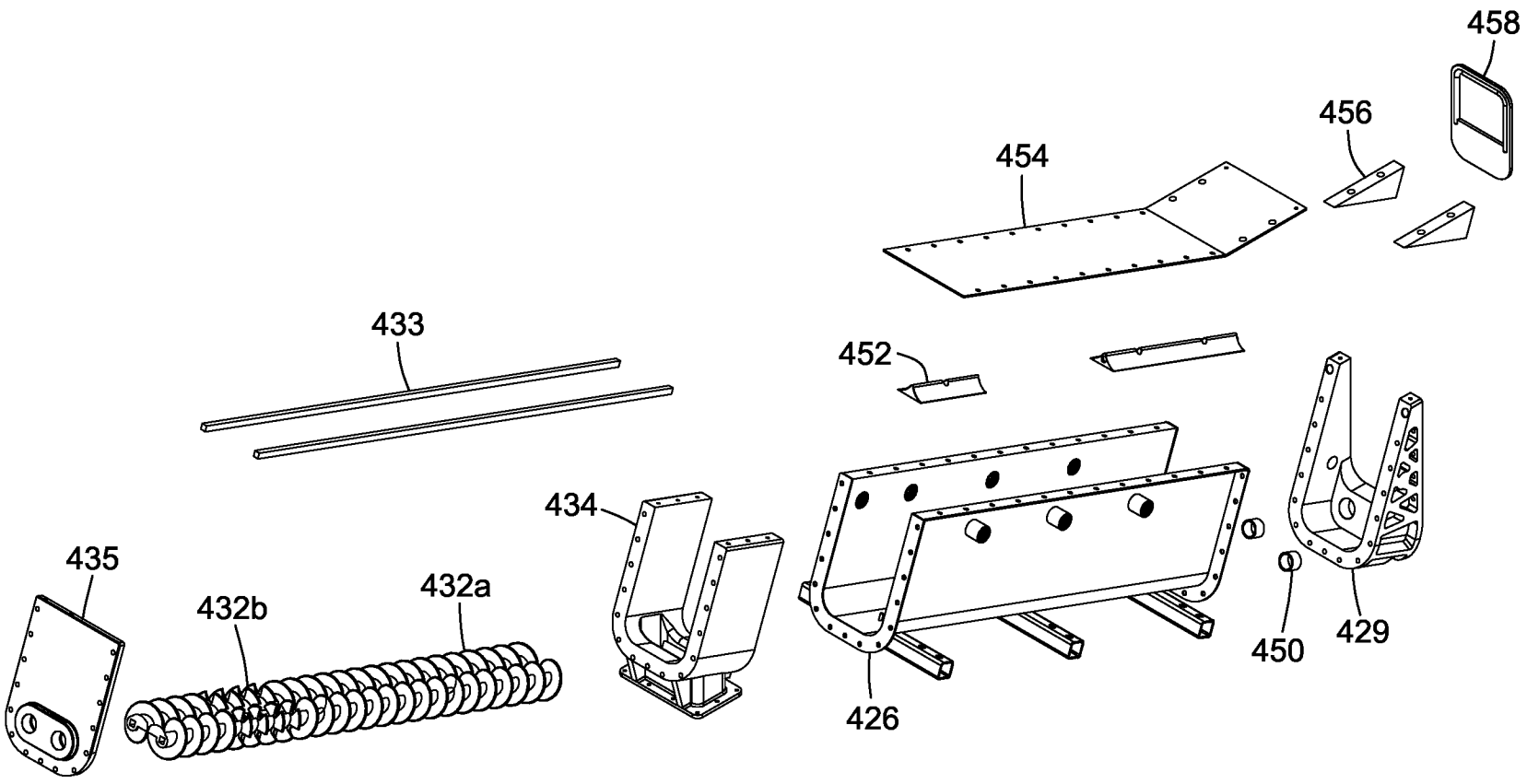

The classifier assembly 418 includes a classifier trough 426 having a lower upstream end 428 connected to the primary extraction assembly 420 via a transition zone 429, and an upper downstream end 430 extending away from the primary extraction assembly 420. The classifier assembly 418 includes a conveyance assembly for conveying material from the transition zone 429 towards the downstream end 430. The conveyance assembly may be at least one auger 432, located within and extending along a length of the classifier trough 426. In the illustrated implementation, the conveyance assembly includes a dual-auger assembly including two side-by-side augers 432 as shown in FIG. 8, the side-by-side augers 432 being operable to mix the oil sands ore with the solvent and convey the extracted solids in the downstream direction as solvent flows in the opposite direction and collects bitumen from the solids. The lower upstream end 428 of the classifier assembly 418 engages oil sands solids discharged from the primary extraction assembly 420, and, via rotation of the augers 432, the oil sands solids is transported toward the upper downstream end 430 while separation and washing are facilitated by the displacement and mixing of the solids with the solvent within the classifier assembly 418. The countercurrent flow of the solids and extracted bitumen/solvent mixture promotes washing of the solids within the classifier assembly 418. It is noted that, in general, the extractor 142 including the primary extraction assembly 420 and the classifier assembly 418 can be configured and operated for countercurrent movement of the solids and liquids, such that extraction, separation and washing occurs in a single integrated vessel instead of two or more separate vessels for respective operations.

Referring back to FIGS. 5 and 6, the upstream end 428 of the classifier assembly 418 is in fluid communication with the primary extraction assembly 420, such that the solids and upstream ends of the augers 432 can also be below a liquid level in the trough 426. As the solids are lifted upwardly and travel downstream within the classifier assembly 418, the solids will eventually rise above the liquid level of the solbit, and solvent added further downstream will drain by gravity to further wash bitumen from the solids. The classifier assembly 418 therefore includes a submerged section and a non-submerged section. The angle of the classifier section and its length can be provided to enable a desired function for this section.

Referring to FIG. 8, the classifier assembly 418 can have various possible designs. In one implementation, the classifier assembly 418 includes at least one rotating element that rotates about a longitudinal axis of the classifier trough 426. For example, the rotating element can be an auger-type element 432. The auger 432 can include a single auger, dual augers arranged side-by-side, or other configurations of multiple augers arranged within a correspondingly constructed trough. In the illustrated implementation, the auger includes a dual-auger assembly, each auger 432 having a corresponding shaft 433 and a blade or flightings helically mounted around the corresponding shaft 433. In a dual auger configuration, the auger flights can be designed to promote mineral solids displacement in a downstream direction, and solbit drainage in an upstream direction, i.e., toward the primary extraction assembly. For example, the augers 432 can include conveying auger sections 432*a* and one or more drainage auger sections 432*b* (e.g., pug auger sections) shaped and configured to promote solbit drainage. It should nevertheless be noted that the rotating elements of the classifier assembly can have various features and constructions for conveying the solids while allowing solvent addition and drainage counter-currently with respect to the solids.

In FIG. 8, a main upstream section of the dual augers 432 includes full helical flights, followed by a shorter section where the flights are cut to promote solbit drainage, followed by an end section where the flights are again configured as full helical flights. The drainage auger sections 432*b* can have flights which are shaped and sized such that conveyance is somewhat hindered in order to promote in-place mixing, along with solbit drainage. The drainage auger sections 432*b* can be located in a non-submerged section of the classifier assembly 418. It should be noted that there are various configurations of the flights, including full and cut helical sections and different sizes and arrangements, that are possible along the length of the shafts 433 of the classifier assembly 418. In some implementations, the drainage auger sections 432*b* are positioned in the classifier assembly 418 at locations where additional solvent is introduced, although other configurations are possible. It is also possible to include discrete projections extending from the shafts 433 of the rotating elements rather than continuous flights, and such discrete projections could have various designs to enable the desired mixing, transport and washing functions along different segments of the shaft.

Referring still to FIG. 8, the classifier trough 426 has a tailings discharge main 434 (i.e., an outlet) at the downstream end 430 to allow evacuation of tailings material, and a back cap 435 connected to the discharge main 434 for closing off the trough 426 and promote evacuation of tailings material through the discharge main 434. The back cap 435 can also be adapted to act as a shaft guide, whereby the shafts 433 of the classifier assembly 418 are secured to the back cap 435, for example, via bearings (not shown). Similarly, the shafts 433 can be further connected to the transition 429 via a pair of bearings 450. The classifier assembly 418 further includes a motor system which can be mounted at the downstream end to drive rotation of the two shafts 433 of the augers within the trough 426. Of course, the motor system can be arranged in the appropriate location depending on the position and structure of the rotating elements of the classifier assembly.

As seen in FIGS. 5 and 6, the classifier assembly 418 can be oriented at an oblique angle to facilitate back drainage of the solbit. The angle can be provided along with other parameters (e.g., auger design, sizing and spacing; speed of rotation; and auger conveyor length) in order to enable desired extraction, separation or washing characteristics as well as extractor performance. In some implementations, the oblique angle can be between about 15 degrees and about 45 degrees, or about 20 degrees and about 35 degrees. The angle can be adjustable, for example by having an adjustment assembly that can raise or lower the downstream end of the classifier assembly 418. The angle adjustment can be done during operation or in between operations during downtime. Alternatively, the extractor can be built so that the angle remains fixed.

Other parameters can be adjusted and coordinated to enable desired extractor performance. For example, when oil sands ore is fed to the extractor at a rate between about 50 kg/h and about 350 kg/h, or between 100 kg/h and 250 kg/h; solvent can be fed at a rate between about 15 kg/h and about 150 kg/h or between about 30 kg/h and about 100 kg/h. Depending on the sizing and design of the extractor, increased ore feed rates can be accompanied by increased solvent feed rates to maintain the desired solvent-to-ore ratio. In addition, if such an extractor were provided with higher feed rates of solids and solvent, the extractor may benefit from increased rotational speed of the rotating elements 432 of the classifier assembly and/or of the primary extraction assembly. For such an example extractor, rotation speeds of the classifier augers 432 can vary between about 5 rpm and about 40 rpm, or between 10 rpm and 25 rpm; while the rotational speed of the log washers in the primary extraction assembly can vary between about 50 rpm and 210 rpm or about 100 rpm and 150 rpm. It is noted that the ranges of operating parameters mentioned above relate to an example pilot unit, and that modifications to the extractor size and design may result in changes to the operating parameters. For example, larger scale extractors would of course have higher input feed rates for the ore and solvent, and could also operate at lower rotational speeds for the log washers and augers or other rotating elements, depending on the size of the unit and scale-up considerations. Various other modifications can also be made to larger scale extractors.

Regarding the design of the classifier trough 426, in the implementation shown in FIG. 8, the trough 426 can include, among other components, a center ridge 452 provided along a bottom surface thereof; a top cover plate 454; transition fillers 456; and a weir 458. The center ridge 452 can be used to fill gaps along the classifier trough 426 (e.g., between the shafts 433 and augers 432) to at least partially avoid accumulation and aging of the oil sands ore. The weir 458 can be configured to increase residence time of the oil sands ore in the extractor trough by reducing the area through which the ore can travel between the extractor and classifier troughs. It is noted that such a center ridge and weir can be absent in various implementations of the unit.

The solvent (e.g., fresh solvent or in the form of solbit) can be introduced into the classifier assembly 418 to promote extraction, separation and washing of bitumen from the solids. In some implementations, solvent-containing streams can be introduced at various solvent inlets 460 (e.g., as shown in FIG. 36) provided at various locations along the extractor 142. The extractor is operated so that the oil sands material proximate the transition 429 between the classifier assembly 418 and primary extraction assembly 420 is immersed in solbit. As the oil sands material is transported and churned by the augers 432 away from the lower upstream end 428, the mineral solids are generally forced toward the upper downstream end 430 while solbit flows counter-currently toward the lower upstream end 428 and collects bitumen from the mineral solids. Solvent introduced proximate to the upper downstream end 430 can be of higher solvent content to promote cleaning of residual bitumen in the solids fraction, while solvent introduced at other locations can be a solbit stream having higher bitumen content, for example. Solvent introduced at the various solvent inlets 460 can initiate the countercurrent wash process as solvent flows generally downwardly, while solids containing bitumen are discharged from the primary extraction assembly into the classifier assembly 418 via the transition 429. In general, when different solbit streams are fed into different sections of the extractor, the composition of the solbit feed streams should be different (e.g., lower bitumen concentration) from the composition of the solbit liquid within the extractor to enhance efficiencies. In other words, solbit compositions should be provided to promote a compositional difference that enhances mass transfer of bitumen into the solbit.

The tailings material discharged from the upper downstream end 430 of the classifier assembly 418 is solids rich and bitumen depleted while containing some residual bitumen and solvent. This solvent containing tailings material may not be a pumpable material as it has relatively high solids content (e.g., a dense phase, a fluid-saturated solid, or a cake-like material) such that it can be subjected to dry materials handling and transport techniques. Alternatively, the tailings stream may be re-fluidized using an intermediate process fluid to facilitate hydraulic transport. In the implementation shown in FIG. 37, the discharge main 434 of the classifier assembly 418 can be part of a discharge assembly which allows tailings, among other components, to exit the classifier assembly 418 proximate the upper downstream end 430.

Figure 9:
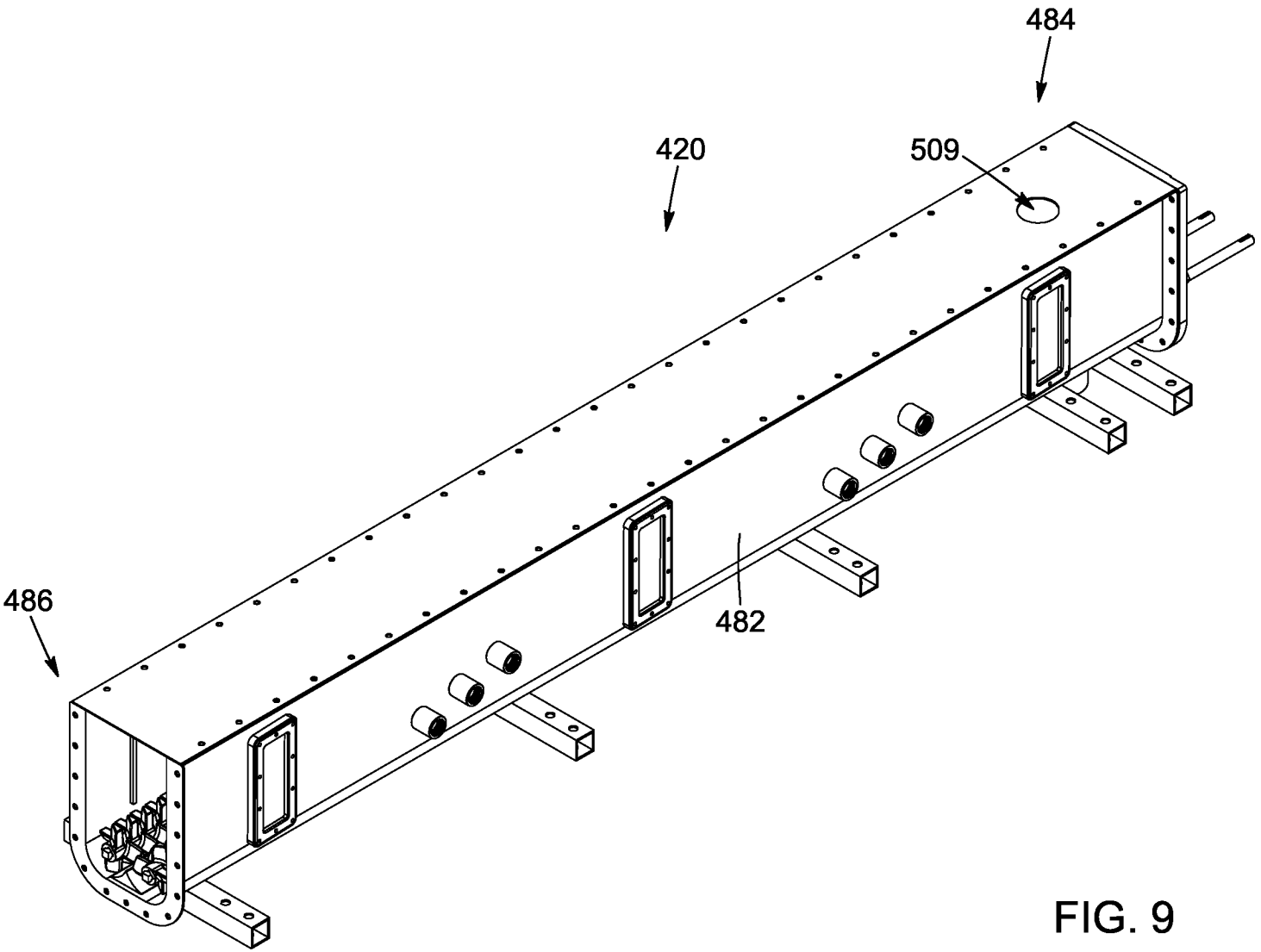
Figure 10:
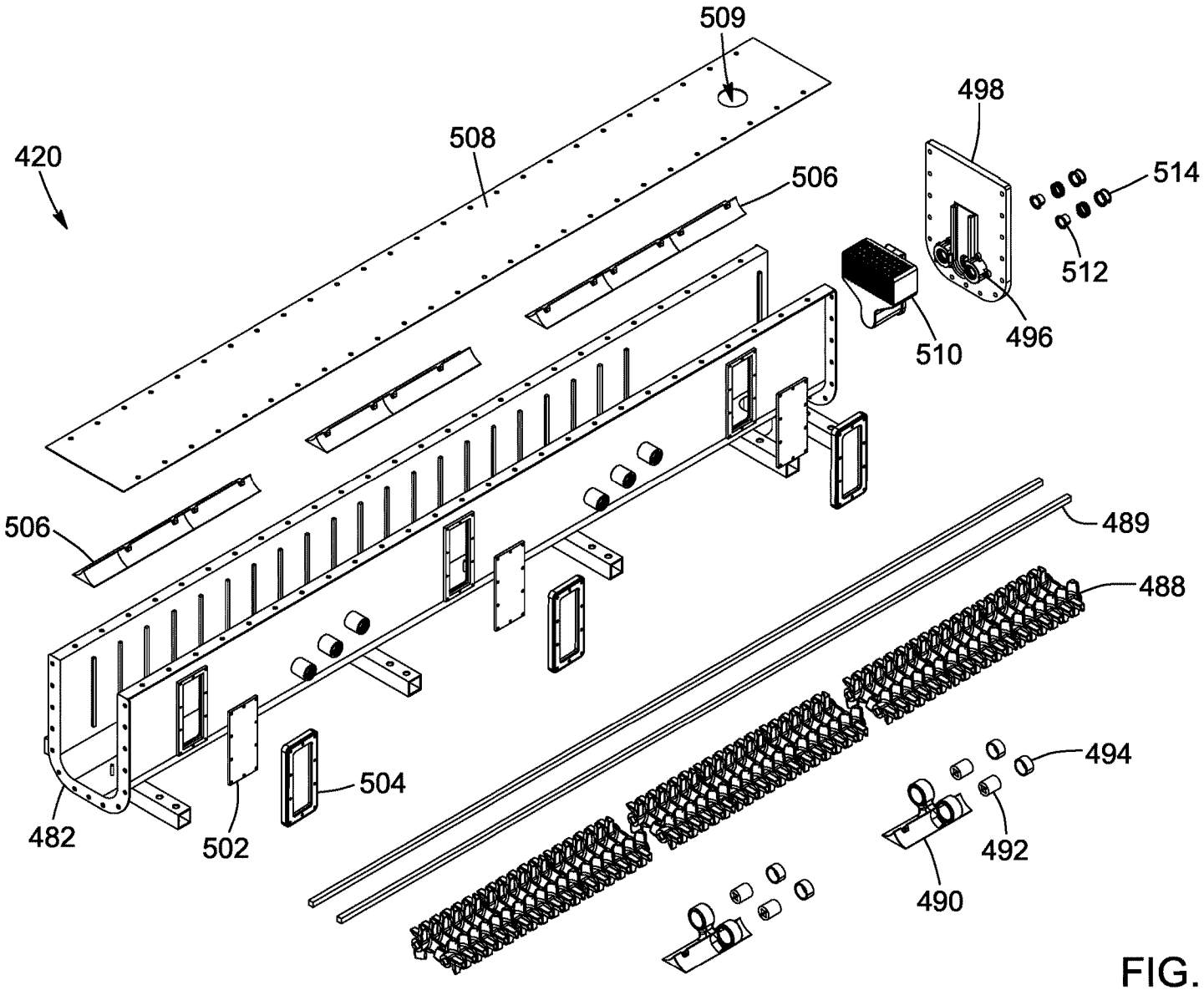
Figure 11:
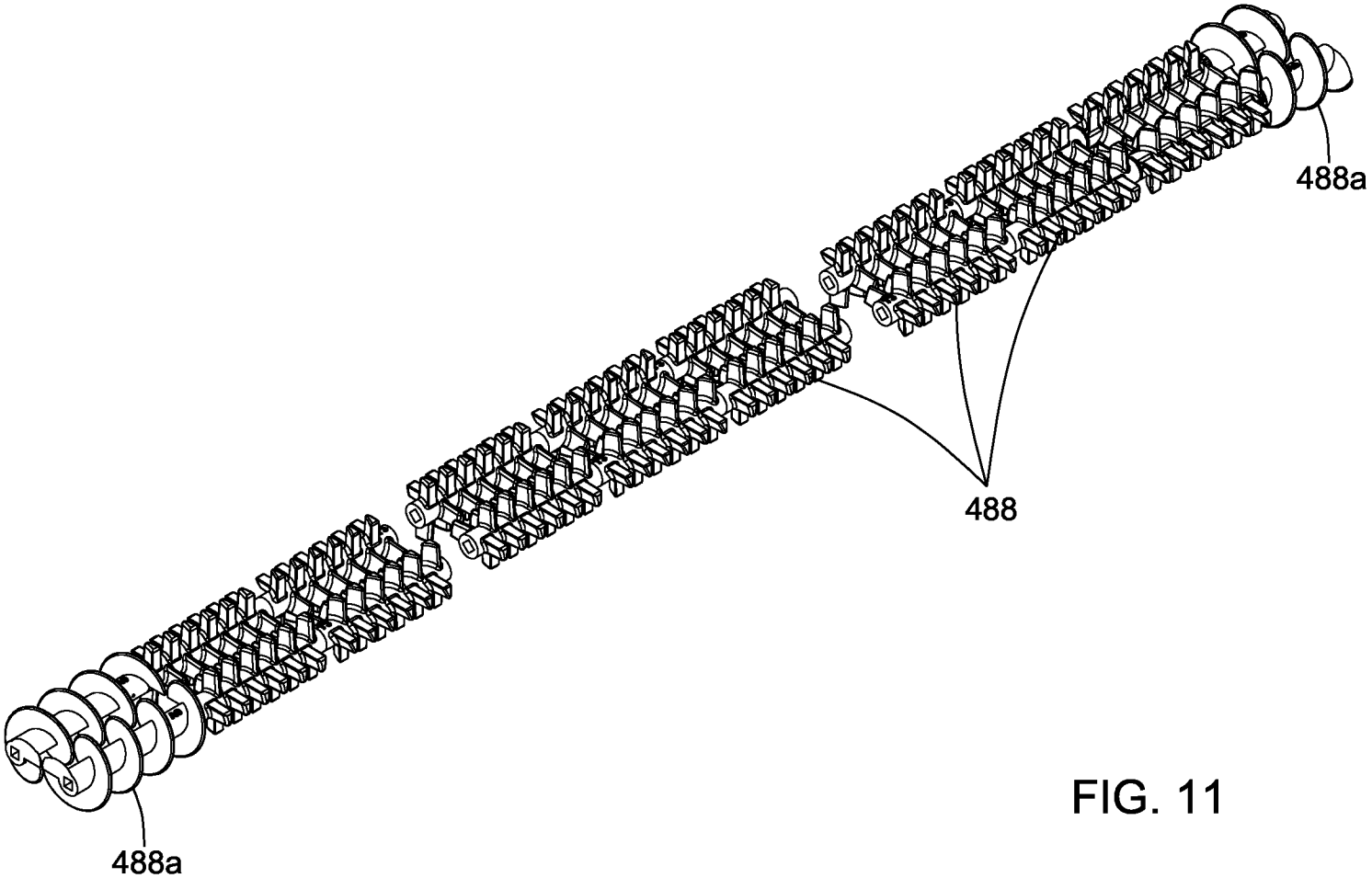

Referring now to FIGS. 9 to 11, the primary extraction assembly 420 will be described in more detail. The primary extraction assembly 420 is the upstream section of the extractor 142 and receives the sized oil sands at its upstream end 484. The primary extraction assembly 420 also produces the solvent diluted bitumen stream that is subjected to further processing in downstream unit operations. It is noted that the extractor 142 typically receives a crushed sized oil sands ore as the feed material, but it can also receive oils sands material in other forms, such as a slurry that includes ore and solvent previously mixed together.

Referring to FIGS. 9 and 10, the primary extraction assembly 420 includes an extractor trough 482 having an upstream end 484 and a downstream end 486, the downstream end 486 being connectable to the classifier assembly 418 via the transition zone 429. The oil sands ore material can be fed into the primary extraction assembly 420 from above and proximate the upstream end 484 via a feedwell that feeds ore from a sized ore hopper. Other locations for feeding oil sands ore into the primary extraction assembly 420 are also possible. An ore inlet 509 is provided in fluid communication with the feedwell. The ore inlet 509 can be provided as an opening in the top of the primary extraction assembly 420. The oil sands solids material is submerged in the solbit at the upstream end of the primary extraction assembly 420 and is subjected to digestion, mixing and extraction upon entering the primary extraction assembly 420.

The oil sands ore material is then conveyed along the extractor trough 482 via the action of at least one rotating element 488, which can be configured so as to extend along the extractor trough 482. Each rotating element 488 includes a shaft 489 and a plurality of projections extending radially outward therefrom. The projections may be of various types, including baffles, paddles, blades, rods, flights, augers, and/or other types of projections that are discrete or continuous. In some implementations, the rotating element 488 is configured as a log washer that includes a shaft and at least some discrete projections. The shaft 489 of each rotating element 488 can also have various designs, having a small or large diameter, being configured for connection of certain projections thereto, being constructed to enable mounting within the extractor trough 482 in a certain manner and to connect with motors, and so on. During this conveyance, the rotating element 488 provides digestion of the oil sands while facilitating extraction of the bitumen which forms part of the solbit moving counter-currently and also advancing the solids downstream. The region above the rotating element 488 enables separation of the solbit from the solids, and the solbit can be withdrawn for the primary extraction assembly 420 for instance once the solbit overflows over the weir 510 at the upstream end 484 of extractor trough 482.

The primary extraction assembly 420 can have various possible design features. For example, the rotating element 488 can be a single shaft configuration, a dual shaft configuration arranged side-by-side (as illustrated), or can have other configurations of multiple shaft rotating elements 488 arranged within a correspondingly constructed extractor trough. In the illustrated implementation, a dual shaft primary extraction assembly 420 is provided, with each rotating element 488 having a corresponding shaft 489 and baffles, paddles, blades, rods, flights, augers, and/or other types of projections mounted around the corresponding shaft. In the implementation shown in FIGS. 9 to 11, the dual rotating elements 488 can be referred to as a pair of log washers.

It is appreciated that, in a dual shaft configuration, the projections of the rotating element 488 can be designed to impart mixing energy to the oil sands and facilitate digestion and extraction while also conveying or advancing the solids downstream along the extractor trough 482. The projections can therefore be angled or shaped to impart a certain degree of force in a downstream direction. The projections can be designed and configured to provide a desired combination of mixing and advancing.

In some implementations, and as shown in FIG. 11, the rotating element 488 can include auger sections 488*a*, e.g., provided at one or both end of the shafts 489. These auger sections can be provided to prevent ore accumulation in these regions. Alternatively, the entire length of the rotating elements 488 can be equipped with a similar or an identical pattern of projections. Auger sections 488*a* can be provided at one or more locations at various places along the shafts.

It is also possible to equip the rotating elements 488 with a mixed complement of different projections along the length of the shafts, to provide certain functionalities (e.g., advancing, mixing energy, etc.) at certain points along the extractor trough 482.

It should be noted that the rotating elements 488 can have various features that can be designed and implemented depending on certain functions that may be desired in different parts of the primary extraction assembly. For instance, the rotating elements 488 can have various combinations of discrete and continuous projections extending from the shafts 489. The rotating elements 488 can also be divided into shaft segments having different lengths and/or arrangements. Each shaft segment can have a different arrangement of projections, in terms of their type, structure, spacing, length, orientation, angle, width, distribution, and so on. There may be up to "n" segments that make up the rotating element 488. Each segment can be designed to provide or promote desired functions. For instance, a segment can be designed to promote transportation of the solids with lower mixing energy (e.g., using an auger type structure), while another segment can be designed to promote digestion and extraction (e.g., using paddles that are designed to provide high mixing energy to the solids). Each segment along the shafts of the rotating element 488 can therefore be tailored in various ways to provide desired effects. The segments can be of the same or different length. When two side-by-side rotating elements 488 are used, they can be substantially the same in terms of their segments or they can be different. Alternatively, the rotating elements 488 can also be provided so that the projections are the same along the entire length of the shaft and are provided in a single consistent arrangement.

Projections Designs and Mounting Structures

FIGS. 12 to 28 show various example implementations of rotating elements that can be part of the primary extraction assembly 420. Details regarding each of these implementations will be described in the following paragraphs.

Figure 12:
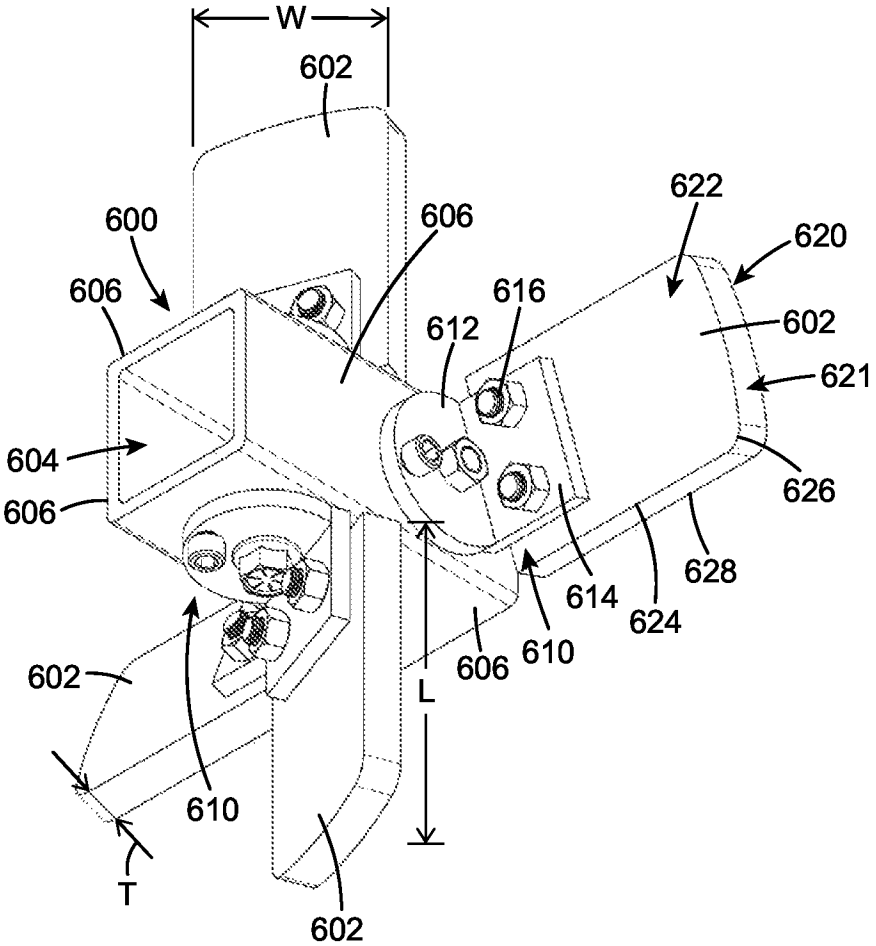
FIG. 12 is a perspective view of a shaft mounting structure of a rotating element, the shaft mounting structure including a shaft receiving hub, and associated projections.
Figure 16A:
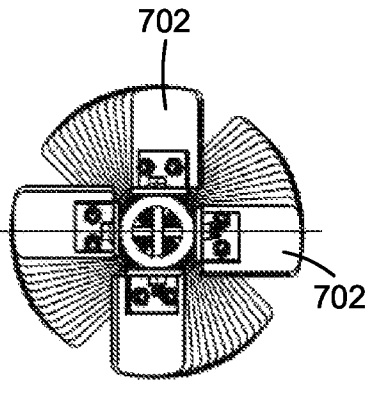
FIGS. 16A-16B is a front view of the shaft mounting structure and associated projections shown in FIG. 14.
Figure 16B:
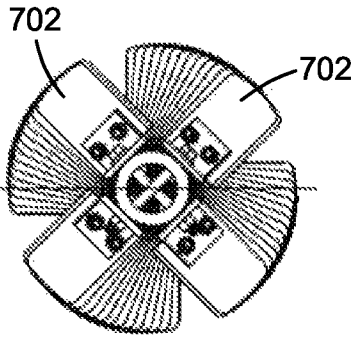
Figure 14:
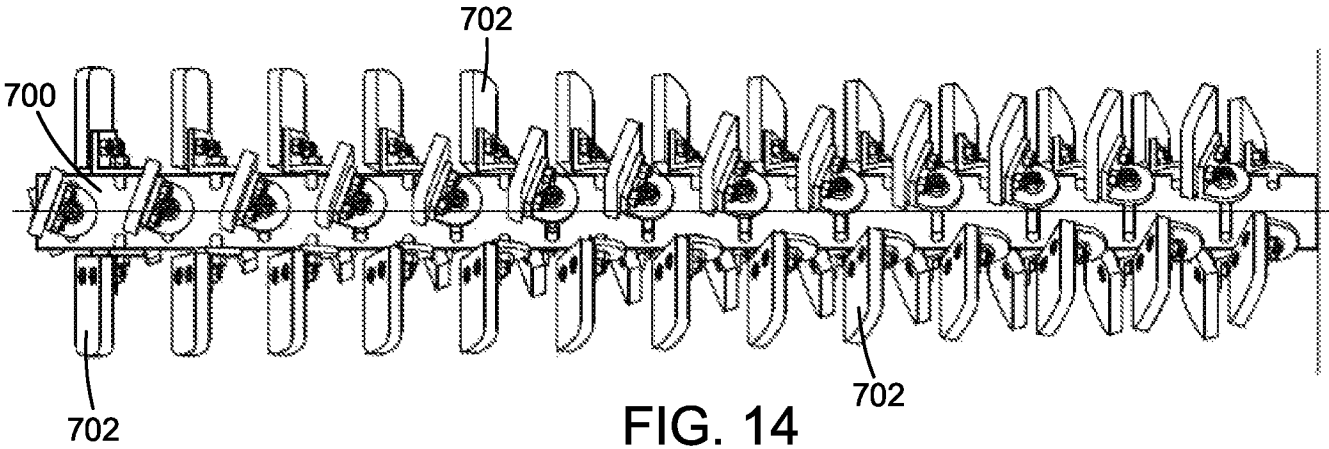
FIG. 14 is a side view of a shaft mounting structure and associated projections, the shaft mounting structure including a shaft receiving hub and elongated slots.

FIG. 12 illustrates an example of a shaft mounting structure 600 and associated projections 602. In the following paragraphs, when referring to projections, it is to be understood that the projections can also be referred to as paddles or blades, with the term "projection" broadly referring to various possible shapes of an elongated member extending outwardly directly or indirectly from a shaft. When the projection extends indirectly from the shaft, it is meant that additional components are provided in between the shaft and the projection to mount the projection to the shaft.

The shaft mounting structure 600 is configured to be mounted to a shaft, such as the shaft 489 shown in FIG. 10. The shaft mounting structure 600 includes a shaft receiving hub 604 configured to receive the shaft 489 therein, and optionally, a mounting assembly 610 that connects the projections 602 to the shaft receiving hub 604. For instance, the shaft mounting structure 600 can be slid over a shaft 489, and maintained on the shaft 489 by the presence of a retaining device at each end of the shaft. Alternatively, the shaft mounting structure 600 can be affixed to the shaft 489 and secured thereto with any type of fasteners known in the art.

In FIG. 12, the shaft receiving hub 604 has a shaft receiving hub profile that is shaped as a substantially square tube. It is to be understood that the shape and size of the shaft receiving hub profile can be determined in accordance with the characteristics of the shaft 489 onto which the shaft mounting structure 600 is mounted. For example, both the shaft 489 and the shaft receiving hub 604 may both have a substantially square cross-section to facilitate the insertion of the shaft 489 into the shaft receiving hub 604 and cooperation of the contact surfaces after insertion. The shaft receiving hub 604 defines a passage through its tubular walls and the passage can be sized and configured to provide sufficient play to allow the insertion of the shaft 489 and yet also provide a relatively snug fit between the components. When the shaft 489 has a polygonal profile, i.e., that includes edges, and the shaft receiving hub 604 has a complementary shape, this construction can contribute to facilitating the locking of the shaft mounting structure 600 onto the shaft once the shaft is in rotation, and/or the insertion of the shaft 489 into the shaft mounting structure 600. In other words, the polygonal shape of the shaft and hub can facilitate axial insertion during assembly as well as radial locking of the two components during assembly and operation.

It is to be understood that although the shaft receiving hub 604 of the shaft mounting structure 600 shown in FIG. 12, as well as in FIGS. 20 to 27, is exemplified as having a square profile, the shaft receiving hub 604 can also have any polygonal profile, such as a triangular profile, a rectangular profile, a pentagonal profile, a hexagonal profile, and so on. In some implementations, the shaft receiving hub 604 can also have an edgeless profile, such as a circular profile. The profile can be provided depending on various factors, such as the number of side wall on which the projections are mounted based on the designed distribution and number of projections for the rotating elements. The profile of the shaft receiving hub 604 can also have a configuration that facilitates locking of the shaft mounting structure 600 onto the shaft. In order to do so, the shaft receiving hub 604 can include additional features, such as protrusions, that can engage with complementary features provided along the length on the shaft, for instance to provide a key joint connection between the shaft mounting structure 600 and the shaft. Some additional features that can be provided for the shaft receiving hub 604 will be described below.

In the implementation shown in FIG. 12, the shaft receiving hub 604 includes four outer surfaces 606, with a projection 602 being removably engaged with each outer surface 606. Each outer surface of a shaft receiving hub can include a single projection or a plurality of projections depending on the size of the hub, for example. The projections 602 extend outwardly from the shaft receiving hub 604. In the implementation shown in FIG. 12, the central axis of each projection 602 extends perpendicularly from the corresponding outer surface 606 of the shaft receiving hub 604 and also perpendicularly with respect to a central longitudinal axis of the shaft receiving hub 604 and the shaft. In other implementations, the central axis of the projections can be at an angle different than 90° from the corresponding surface 606 of the shaft receiving hub 604. In addition, the projections 602 can be mounted on respective outer surfaces 606 of the shaft receiving hub 604, such that the four adjacent projections are provided at about 90° angle from each other. It is to be understood that for a shaft receiving hub 604 having a different profile than a square profile, the adjacent projections can be provided at angles different than about 90°, and could be provided for instance in a 1, 4, 8 and 11 o'clock configuration, or in accordance with any other suitable configuration. In some implementations, each one of the four projections can extend outwardly in a given quadrant defined around the shaft.

Various forms and configurations of the projections can be used in conjunction with the shaft mounting structure 600. In some implementations, the projections are paddle- or blade-shaped in that the projections are elongated (e.g., with a length-to-width ratio greater than 1, such as 1.5, 2. 2.5 or greater) and thin (e.g., with a thickness that is smaller than the width, such as three, four, five, six times or more smaller than the width). As shown in FIG. 12, the projections 602 can be angled relative to a transverse plane extending perpendicularly with respect to the longitudinal axis of the shaft which would also extend within the shaft receiving hub 604. The angle can be provided such that the rotation of the shaft encourages the front contact surface of the projection to push the solid material toward the downstream end of the shaft and trough. Depending on the rotation speed and other process parameters, the angle can be provided to facilitate faster or slower advancement of the solid material. In some implementations, a projection 602 can be provided for instance at an angle ranging between about −45° and about +45° relative a transverse plane extending perpendicularly to the longitudinal axis of the shaft. In other words, the projection 602 can extend at an angle of 45° on either side of the transverse plane extending perpendicularly to the longitudinal axis of the shaft. When a projection 602 extends parallel to the transverse plane extending perpendicularly to the longitudinal axis of the shaft, it is meant that the projection extends along that transverse plane. In other words, the projections 602 can be provided so as to extend at a neutral angle of 0° relative to a transverse plane extending perpendicularly across the longitudinal axis of the shaft. In addition, depending on the shape and configuration of the projections, they may be mounted in various ways. For example, for a paddle- or blade-like shape, the entire paddle or entire blade can be mounted at a desired angle, as discussed above. For other shapes, each projection can be mounted to the shaft such that its front facing surface 620 is at a desired angle while the rest of the body of the projection may or may not be angled per se.

Figure 28:
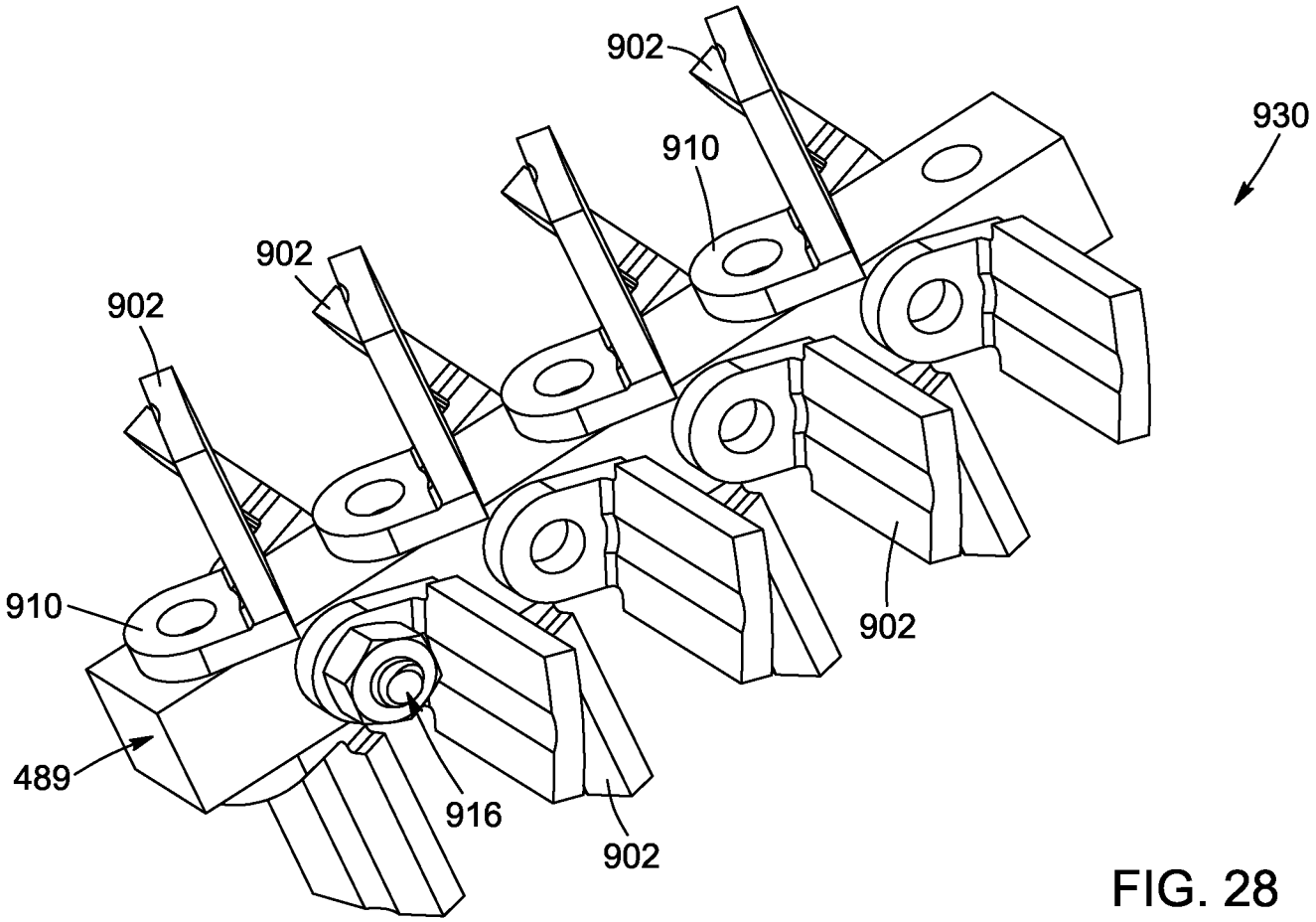
FIG. 28 is a perspective view of projections being directly and removably engaged with a shaft.

As shown in FIG. 12, the projections 602 can be removably mounted onto the shaft receiving hub 604 via the mounting assembly 610. The mounting assembly 610 can include various structures that enable the removable engagement of the projection 602 with the shaft receiving hub 604. In the illustrated implementation, the mounting assembly 610 includes a shaft mounting plate 612 and a projection mounting plate 614, as well as a plurality of engagement devices 616. In some implementations, the shaft mounting plate 612 and the projection mounting plate 614 can together form a bracket. The projection mounting plate 614 can be located on a back face of the projection 602 while the front end of the corresponding fastener has a surface that is generally continuous or flush with the surface of the front face of the projection, or vice versa. The engagement devices 616 can be any type of fasteners, such as screws and/or bolts. Although shown in FIGS. 12 and 13 as two separate components, the mounting assembly 610 and the projection 602 can in some implementations be unitary in construction, such as shown in FIG. 28.

In some implementations, the engagement device 616 can extend from one side of the shaft receiving hub 604 to the other, i.e., across the entire shaft receiving hub 604. In such a configuration, the engagement device 616 can extend through the shaft as well once the shaft mounting structure 600 is mounted onto the shaft, whether the shaft is configured as a full shaft or a tubular shaft, whether the shaft receiving hub 604 has a circular profile or a polygonal profile. When the engagement device 616 from one side of the shaft receiving hub 604 to the other, a single engagement device 616 can be used to secure two opposite projections together. For instance, when the engagement device 616 includes a bolt and a nut, the bolt can be inserted through the shaft mounting plate 612 on one side of the shaft receiving hub 604 and across the entire cross-section of the shaft receiving hub 604 such that the head of the bolt remains abutted to the shaft mounting plate 612, with the threaded end of the bolt exiting at the opposite side and secured to the shaft receiving hub 604 using a nut. In such implementations, the shaft includes openings sized and configured to enable an element of the engagement device 616 such as a bolt to pass therethrough.

As mentioned above, the projections 602 can be removably mounted to the shaft. Thus, the projections 602 can be removed for maintenance, adjustment or replacement when desired. It is noted that depending on the mounting configuration, the projections 602 themselves can be removed from the rest of the components, including the shaft and the mounting assembly 610, or the projections 602 can be removed along with one or more other components such as those used to mount the projections 602 to the shaft. It is noted that the projections can be independently removable and/or the projections can be removable as a group from the shaft for instance along with a shaft receiving hub.

Referring to the configuration of the mounting assembly 610 as shown in FIG. 12, each projection 602 can be removed from the mounting assembly 610 to be replaced when desired. Alternatively, the combination of the mounting assembly 610 and the projection 602 can be removed from the shaft receiving hub 604, and both the mounting assembly 610 and the projection 602 can be replaced if desired. Another alternative is that the combination of the mounting assembly 610 and the projection 602 can be removed from the shaft receiving hub 604, and a projection 602 can be replaced and re-engaged with the mounting assembly 610, and the combination of the mounting assembly 610 and the projection 602 can then be re-engaged to the shaft receiving hub 604 via the mounting assembly 610.

Referring still to FIG. 12, the projections 602 includes a front surface 620, a side surface 621, a back surface 622, a leading edge 628, a trailing edge 624, and corners 626. The projection 602 also has a length "L", a width "W" and a thickness "T". The edges 624, 628 of the projection 602 can be configured to be sufficiently sharp to cut through the oil sands ore material to facilitate digestion, extraction and separation of bitumen from the oil sands ore material in the primary extraction assembly 420. A thin configuration of the projections 602 can also contribute to avoiding accumulation of ablated ore in between the projections, provided that they are distributed at a sufficient distance from each other. For instance, the edge 628 can result from the front surface 620 and the side surface 621 meeting at a 90° angle, such as shown in FIG. 12. Alternatively, the edge 628 can result from the front surface 620 and the side surface 621 meeting at an angle larger than 90°. Similar considerations apply for the edge 628, with the side surface 621 meeting the back surface 622 at a 90° angle or at an angle larger than 90°. When the front surface 620 and the side surface 621 are meeting at an angle larger than 90°, and so is the side surface 621 and the back surface 622, a triangular prism forms at the end of the projection 602. Providing projections that are removably engageable with the shaft receiving hub 604 can be beneficial to facilitate the replacement of the projections, for instance when their edges have become worn down following extended use. In addition, since different sections of the extractor may experience different shear and wear conditions, replacement of the projections can vary over the length of the extractor and over time. Being able to replace individual projections and/or groups of projections that are proximate to each other, can facilitate efficiencies in terms of maintenance downtime as well as material usage for replacement parts, for example. In addition, for some projection designs, the projection can be operated in a first configuration where one of the faces and/or edges experiences greater wear than the others, such that the projection could be reoriented instead of replaced to expose the surfaces and edges that have undergone less wear. For the paddle example, the paddles could be rotated so that the leading edges become the trailing edges and vice versa.

For assembling the rotating elements, a series of shaft mounting structures 600 and associated projections 602 can be mounted successively onto the shaft 489 to obtain a series of projections 602 extending along the length of the shaft 489, thus forming the rotating element 488. In some implementations, each one of the shaft mounting structures 600 is mounted to the shaft. Alternatively, only some of the shaft mounting structures 600 can be affixed to the shaft 489 while other are not directly fixed, to provide stability for the overall series of shaft mounting structures 600 along the shaft 489. For instance, periodic shaft mounting structures 600 can be affixed to the shaft 489 with the others are not affixed to it but are held in between opposed structures 600 can are affixed to the shaft. For example, one shaft mounting structure 600 out of five can be affixed to the shaft 489, or one shaft mounting structure 600 out of any number can be affixed to the shaft 489. Structures 600 on opposed ends of the shaft can be affixed directly to the shaft to retain the rest of the structures 600 in between. In some implementations, three shaft mounting structures 600 can be affixed to the shaft 489, a first one at a downstream end of the shaft 489, a second one in a middle region of the shaft 489, and a third one at an upstream end of the shaft 489. In other implementations, each of the shaft mounting structures 600 can be affixed to the shaft 489. Yet in other implementations, none of the shaft mounting structures 600 are affixed to the shaft 489, and a retaining assembly can be provided at each end of the shaft 489 to retain the shaft mounting structures 600 in position therebetween. In some implementations, the shaft mounting structures 600 can include an interlocking feature can be provided on each opposite end of the shaft mounting structure 600 such that adjacent shaft mounting structures 600 interlock together, thereby contributing to the stabilization of the shaft mounting structures 600 on the shaft 489.

In some implementations, more than one segment of the shaft 489 can be provided in series to obtain a resulting overall length of the shaft. A plurality of shaft segments provided in series can facilitate access and replacement of a given shaft mounting structure 600 and associated projections 602 for replacement, for instance if it is desired to replace projections 602 located in a middle portion of the overall shaft. On the other hand, with configurations where the projections 602 can be removed from the shaft receiving hub 604, either directly or via the mounting assembly 610, the replacement of the projections 602 can be achieved without retrieving the shaft receiving hub 604 from the shaft, even when a single shaft is provided. By providing both the projections and the hubs with removability, the maintenance and modification opportunities for the extractor are enhanced. For example, if a single or a few projections requires inspection or removal, the individual projections can be disconnected and then either replaced or reoriented. If, on the other hand, a group of projections requires inspection or removal, they can be disconnected by removing one or more corresponding hubs which can in some cases be accessed by decoupling one segment of the shaft.

Figure 13:
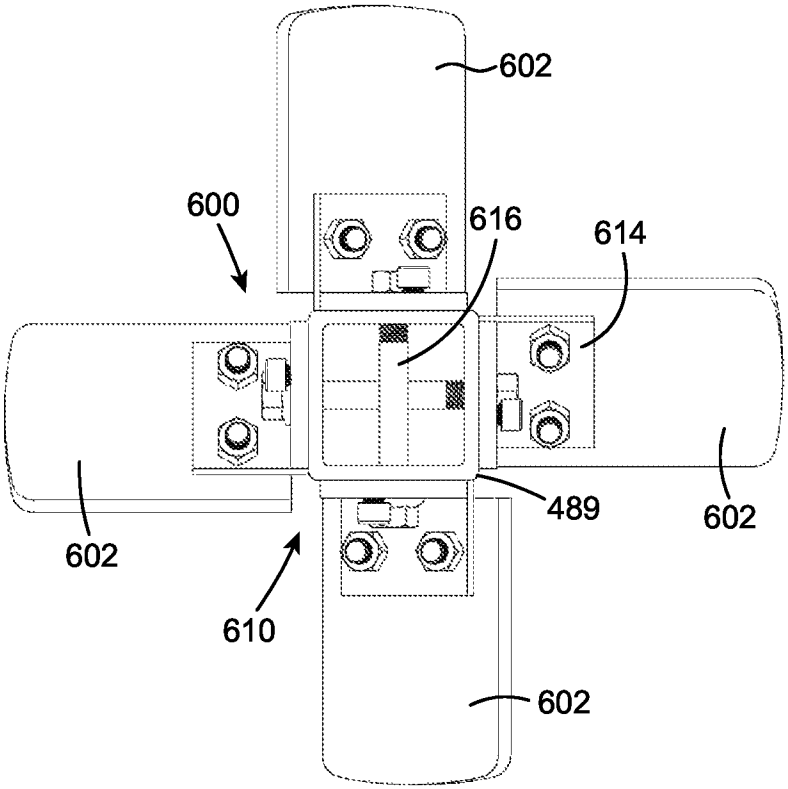
FIG. 13 is a front view of the shaft mounting structure and associated projections shown in FIG. 12.

With reference to FIG. 13, in some implementations, the shaft receiving hub 604 can be omitted, and all the considerations described above in relation with the shaft receiving hub 604 are applicable to the shaft 489 itself. In such implementations, the shaft 489 corresponds to the shaft receiving hub 604, and the projections 602 are secured to the shaft 498 via the mounting assembly 610. In other words, and as shown in FIG. 13, when the projections 602 are secured directly to the shaft 498 via the mounting assembly 610, the mounting structure 600 includes a mounting assembly 610 for securing the projection 602 to the shaft 489. For instance, referring back to FIG. 10, a shaft 489 is shown as having a square profile, and the mounting assembly 610 and associated projections 602 shown in FIGS. 12 and 13 can be mounted directed to the shaft 489. This implementation is similar to the implementation illustrated in FIG. 28, although in FIG. 28, the mounting plate 610 and the paddle are integral with each other. FIG. 13 also illustrates an engagement device 616, illustrated as a bolt and nut, passing through the entire cross-section of the shaft 489 such that the head of the bolt remains abutted to the shaft mounting plate 612, with the threaded end of the bolt exiting at the opposite side and being secured to the shaft 489 using the nut.

Turning now to FIGS. 14 to 18, a projections-receiving shaft 700 and associated removable projections 702 is shown. In this implementation, the projections-receiving shaft 700 is exemplified as a tubular structure, e.g., a hollow cylinder, and includes a plurality of elongated slots 718 along its length. The elongated slots 718 are distributed according to a given pattern along the outer surface 720 of the projections-receiving shaft 700. In the implementation shown in FIGS. 14 to 18, a first set of elongated slots 718 is provided in a spaced-apart relationship relative to one another along a first circumferential arc of the projections-receiving shaft 700, and a second set of elongated slots 718 is provided in a spaced-apart relationship relative to one another along a second circumferential arc of the projections-receiving shaft 700, the first and second sets of elongated slots 718 being longitudinally spaced-apart from one another. In this implementation, each subcomponent includes two projections 702 extending from the first set of elongated slots 718 in opposite directions, and an adjacent subcomponent includes two projections 702 extending from the second set of elongated slots 718, such that each subcomponent is provided at 90° from each other, as shown in FIGS. 16A and 16B, with the projections 702 alternating from a bottom-top configuration to a side-to-side configuration, and so on. In other implementations, adjacent subcomponents can be provided at another angle than 90°. For instance, adjacent subcomponents can be provided at any suitable angle between 45° and 90°. The first and second subcomponents of two projections can also be said to be provided along the first and second sets of two elongated slots respectively, such that each one of the projections of the first and second subcomponents of projections extend outwardly in a given quadrant defined around the projections-receiving shaft 700. Alternatively, in other implementations, each successive elongated slot can be provided around a respective circumferential arc of the projections-receiving shaft 700, i.e., offset from each other or according to a staggered pattern. The elongated slots 718 enable engagement of the mounting assembly 710 with the projections-receiving shaft 700, for instance via a mechanical fastener.

In the implementation shown in FIGS. 14 to 18, the mounting assembly 710 includes a bracket and associated mechanical fasteners, where a portion of the mechanical fastener, such as a bolt or a screw, is received into a corresponding one of the elongated slots 718.

It is noted that in some implementations, a mounting assembly 710 and a projection 702 can be integral with each other.

Figure 15:
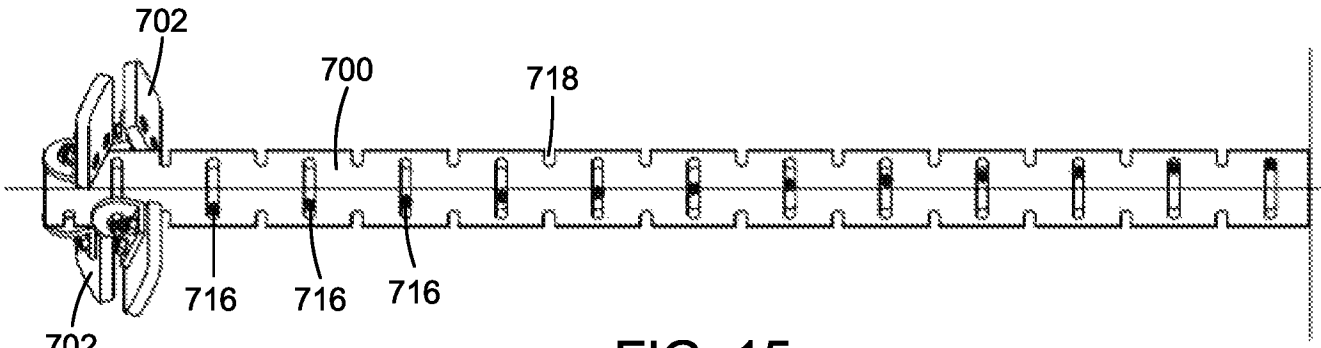
FIG. 15 is a side view of the shaft mounting structure of FIG. 14.
Figure 17:
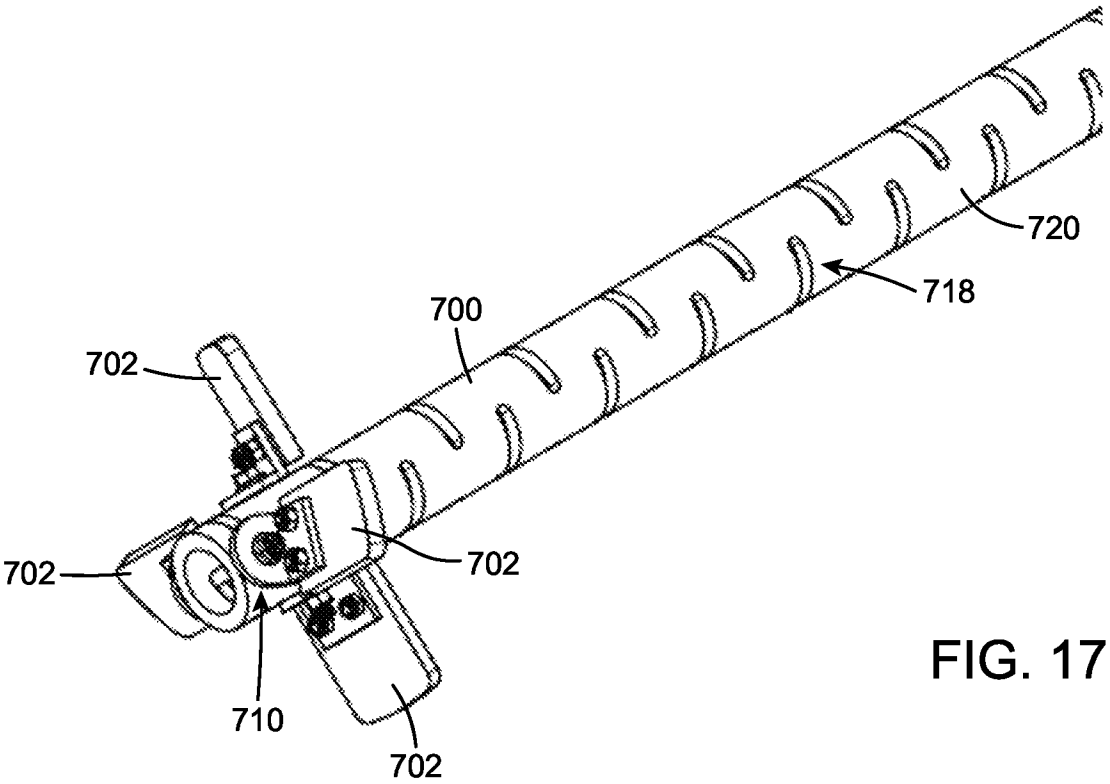
FIG. 17 is a perspective view of the shaft mounting structure shown in FIG. 15.
Figure 18B:
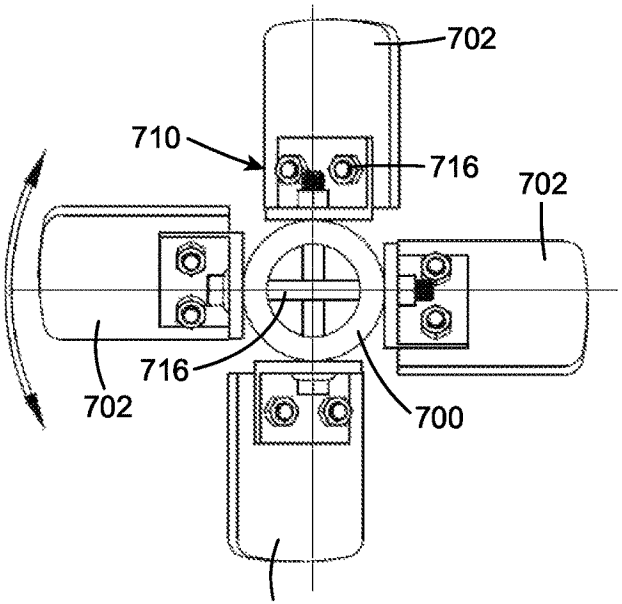
FIGS. 18A-18C illustrates a side view, a front view and a perspective view of a portion of the rotating element shown in FIG. 14.
Figure 18C:
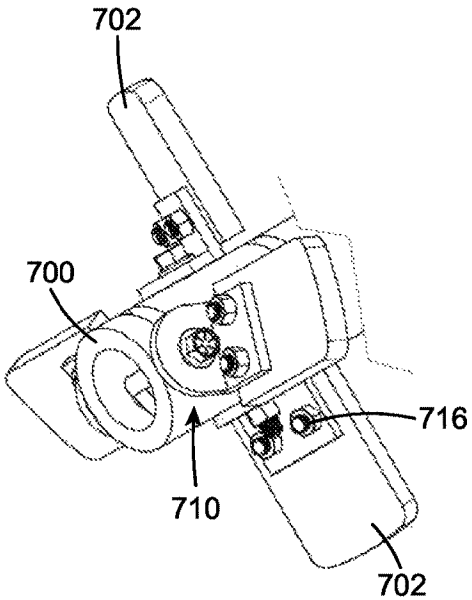
Figure 18A:
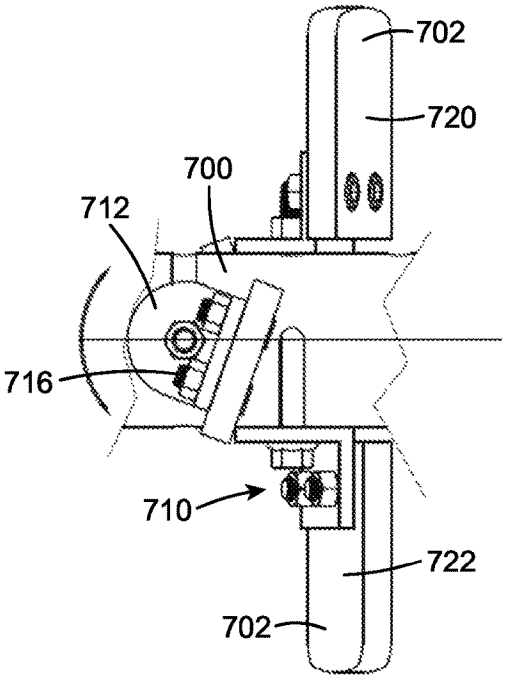

FIG. 15 illustrates examples of the positioning of a series of engagement devices 716, e.g., bolts, that can enable engagement of a corresponding mounting assembly 710 to the projections-receiving shaft 700, for a series of twelve successive elongated slots 718 that are on a same side of the shaft. The engaging devices 716 are shown as being offset or shifted relative each other, to provide an offset configuration of the projections 602 when a plurality of projections 602 are provided along the length of the projections-receiving shaft 700 and secured to the projections-receiving shaft 700 via a corresponding engagement device 716. Thus, instead of having each successive projection 702 along a side of the projections-receiving shaft 700 being in the same circumferential position, the projections 702 can be circumferentially shifted. In FIG. 15 there are twelve positions, but it should be noted that there may be less than twelve or more for a given projection-receiving shaft design.

The elongated slots 718 extend in arcs along the circumference of the projections-receiving shaft 700 such that a given projection 702 can be moved along part of the circumference of the projections-receiving shaft 700 to achieve an offset configuration of the projections 702 around the projections-receiving shaft 700. The positioning of the projections 702 is thus adjustable such that the resulting overall configuration and positioning of the projections 702 can vary along the length of the projections-receiving shaft 700, for instance to achieve the configuration shown in FIG. 15. The result can be that the series of projections 702 follow a helical-like trajectory along the length of the shaft.

In addition, the cooperation of an elongated slot 718 with a corresponding mounting assembly 710 can enable the projection 702 to be positioned at a certain angle relative to a transverse plane extending perpendicularly to the longitudinal axis of the projections-receiving shaft 700, by rotating the projection 702 or the mounting assembly 710 within the elongated slot 718 about a transverse axis of the shaft mounting hub 704 prior to securing in the operable position. The adjustable configuration of the projections 702 can contribute to achieving positive performance in terms of digestion, extraction and separation of the bitumen from the oil sands material, for instance depending on the composition of the oil sands ore material being provided to the primary extraction assembly 420. In some implementations, a projection 702 can be positioned at an angle between about −45° and about 45° relative a transverse plane extending perpendicularly to the longitudinal axis of the projections-receiving shaft 700, or can extend parallel to the transverse plane extending perpendicularly to the longitudinal axis of the projections-receiving shaft 700. In some implementations, the rotating element can be put in function for a certain period of time to evaluate the performance of a given configuration of the projections 702 in terms of their angle relative to the longitudinal axis of the projections-receiving shaft 700, and then the angle of the projections 702 can be modified if it is determined that the performance of the rotating element can be improved. The angle of the projections can be determined so as to achieve a balance between the conveying of the oil sands material along the extractor trough and the extraction of bitumen from the oil sands material or the washing of the bitumen or both.

In the implementation shown in FIGS. 14 to 18, and similarly to what is mentioned above regarding FIG. 13, also illustrates an engagement device 716, such as a bolt and nut, passing through the entire cross-section of the projections-receiving shaft 700 such that the head of the bolt remains abutted to the shaft mounting plate 712, with the threaded end of the bolt exiting at the opposite side and secured to the projections-receiving shaft 700 using a nut.

In other implementations, the configuration of the projections-receiving shaft 700 can be implemented for a shaft mounting structure having a shaft mounting hub that can be slid over a shaft 489, and maintained on the shaft 489 by the presence of a retaining member at each end of the shaft. In other words, a shaft mounting structure can have the elongated slots 718 as described above in relation with the projections-receiving shaft 700. The shaft mounting structure having elongated slots 718 can also be affixed to the shaft 489 and secured thereto with any type of fasteners known in the art. In such implementations, a shaft, a shaft mounting structure having a shaft mounting hub, and associated projections can be said to form a rotating element 488. In other implementations, a series of shaft mounting structures and associated projections 702 can be mounted successively onto a shaft 489 to obtain a series of projections extending along the length of the shaft 489, thus forming the rotating element 488.

In some implementations, more than one segment of the shaft 489 can be provided in series to facilitate access and replacement of a given projections-receiving shaft 700 and associated projections 702 for replacement, or the replacement of the projections can be achieved without retrieving the shaft mounting assembly 700 from the shaft, when a single shaft is provided.

Figure 19B:
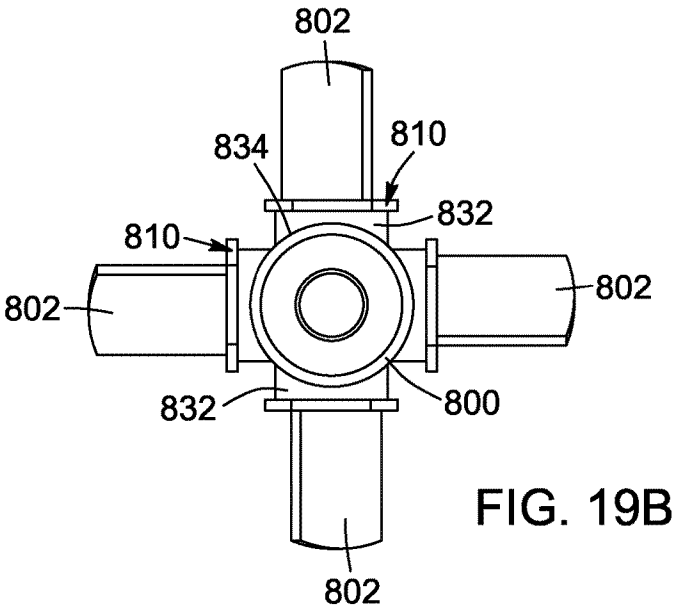
FIGS. 19A-19C illustrates a side view, a front view and a perspective view of a shaft mounting structure and associated projections.
Figure 19C:
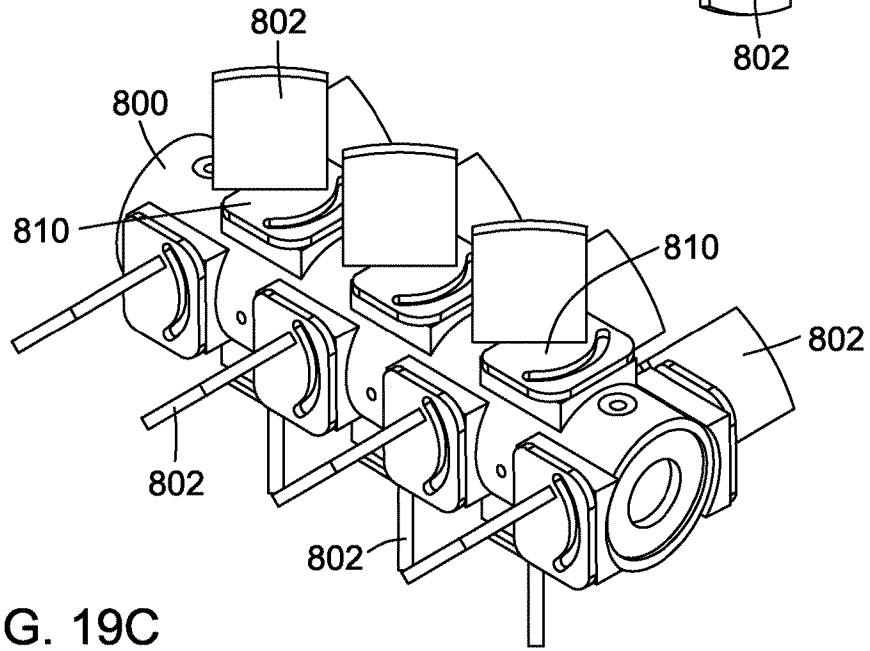
Figure 19A:
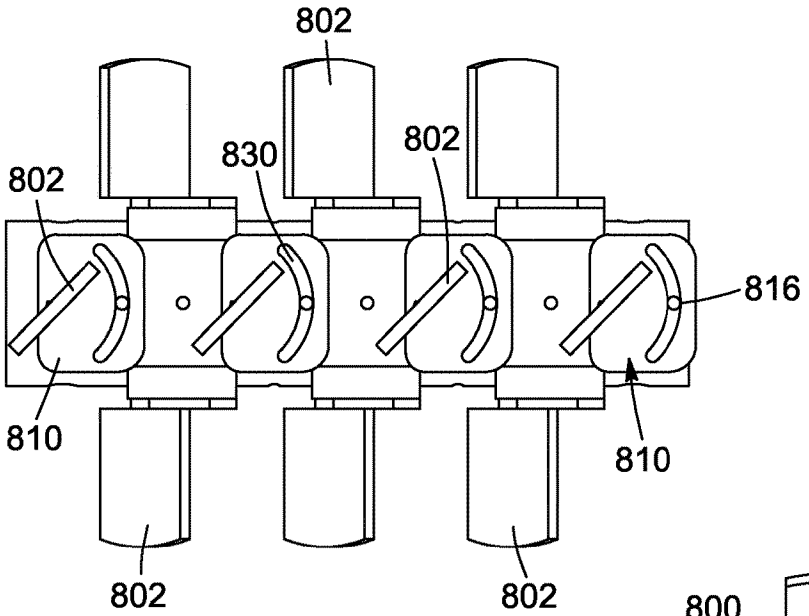

With reference now to FIG. 19, another example of a projections-receiving shaft 800 and associated projections 802 is shown. In this implementation, the projection 802 and the mounting assembly 810 form an integral structure. Alternatively, the mounting assembly 810 can include a projection mounting plate and a shaft mounting plate that are provided as distinct elements to secure the projection 802 to the projections-receiving shaft 800. In the implementation shown, the mounting assembly 810 includes a curved slot 830 forming an arc, and an engagement device 816 extending through the curved slot 830. The engagement device 816 can include for instance a bolt and nut. In the implementation shown, the mounting assembly 810 is seated on a mounting assembly-receiving support 832 that includes a curved profile 834 that embraces the curvature of the projections-receiving shaft 800. Of course, for a projections-receiving shaft having a square profile, the receiving support 832 can have a flat surface that matches the outer surface of the shaft instead of a curved profile. The mounting assembly-receiving support 832 can be for instance welded or screwed to the projections-receiving shaft 800, or can be affixed to the projections-receiving shaft 800 in any other suitable manner. To modify the angle of the projection 802, the mounting assembly 810 can be rotated along the arc formed by the curved slot 830, while the engagement device 816 remains affixed to the projections-receiving shaft 800. The mounting assembly 810 can be secured to the projections-receiving shaft 800 in various ways. For example, when the engagement device 816 includes a bolt and nut, the nut can be used to fix the mounting assembly 810 at a given location along the curved slot 830. In some implementations, a plurality of engagement devices can be provided to limit the range of motion of the mounting assembly 810 along the curved slot 830. In the illustrated implementation, each subcomponent includes two projections that extend in opposite directions, and adjacent subcomponents are provided at 90° relative to one another such that the projections 802 alternate from a bottom-top configuration to a side-to-side configuration. In other implementations, the mounting assemblies can be distributed differently, with the projections of the two subcomponents extending outwardly in a given quadrant defined around the projections-receiving shaft 800.

Figure 20:
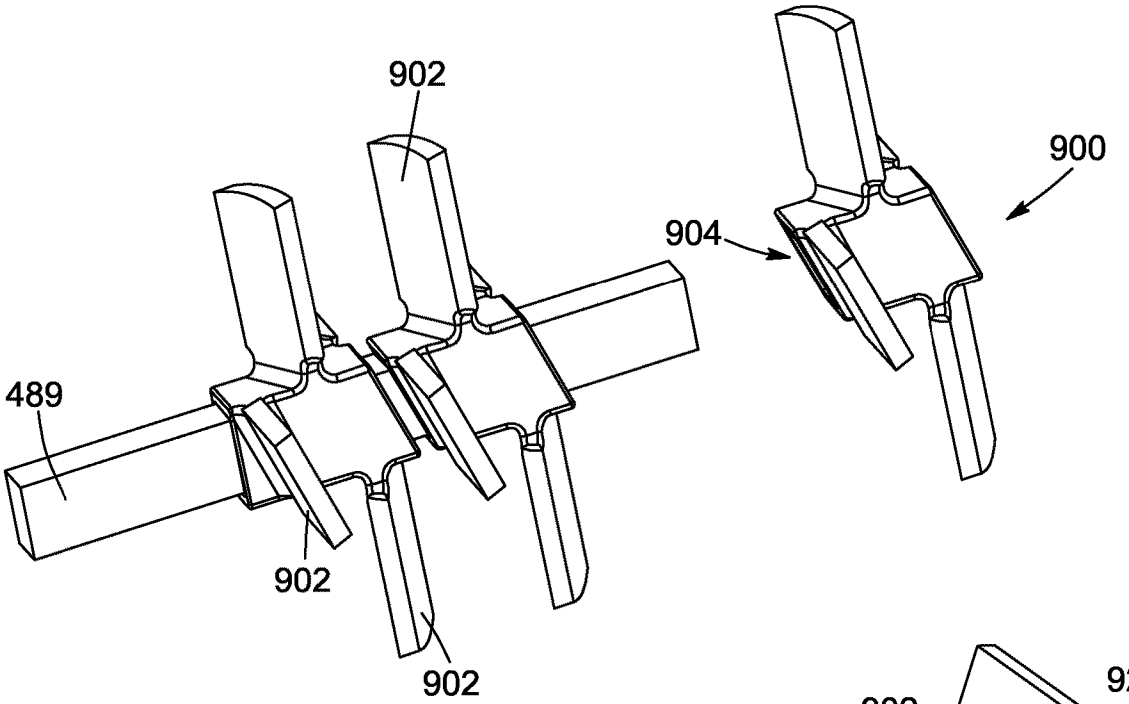

Referring now to FIGS. 20 to 25, implementations of a shaft mounting structure 900 and associated projections 902 that are integral with each other are shown. Referring for instance to FIG. 20, each shaft mounting structure 900 includes a shaft receiving hub 904, from which extend four outwardly extending projections 902, each projection 902 being provided at an angle relative to a transverse plane extending perpendicularly to the longitudinal axis of the shaft 489. As shown in FIG. 20, a series of successive shaft mounting structures 900 can be slid over the shaft 489 to obtain the rotating element 488. In the implementation shown in FIG. 20, the shaft 489 is illustrated as having a shaft profile that is rectangular, with its height greater than its width, and the shaft receiving hub 904 has a shaft receiving hub profile that is also rectangular and complementary to the shaft profile. As mentioned above, the shaft mounting structures 900 can be retained on the shaft 489 via retaining members provided at each one of the opposite ends of the shaft 489, and/or one or more of the shaft mounting structures 900 can be affixed to the shaft 489 via engagement devices such as mechanical fasteners or other engagement devices known in the art.

Various alternative configurations of projections 902 are shown in FIGS. 21 to 25.

Figure 21:
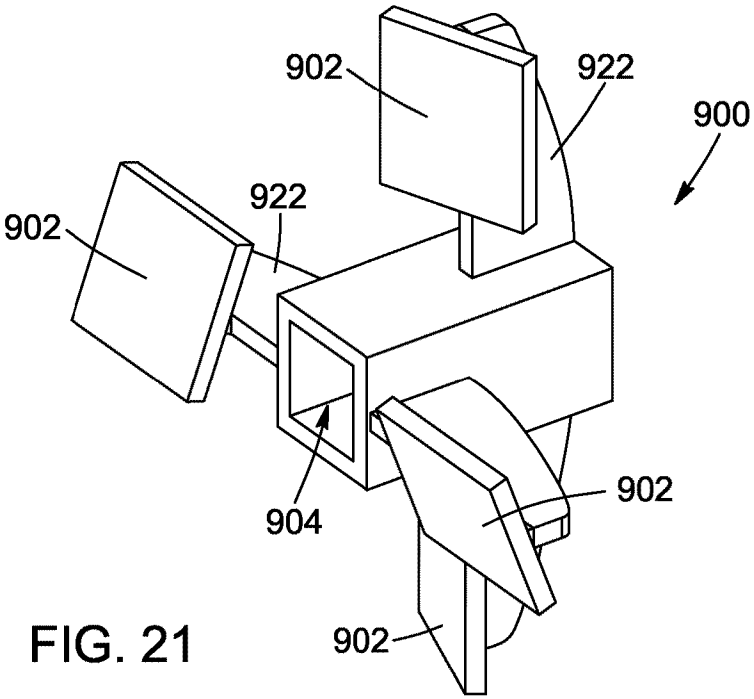
FIGS. 20 to 27 illustrate various examples of shaft mounting structure and associated projections.

For instance, FIG. 21 illustrates an implementation where each projection 902 is provided integral to a support member 922, which can also be referred to as an "arm", outwardly extending from the shaft receiving hub 904.

Figure 22:
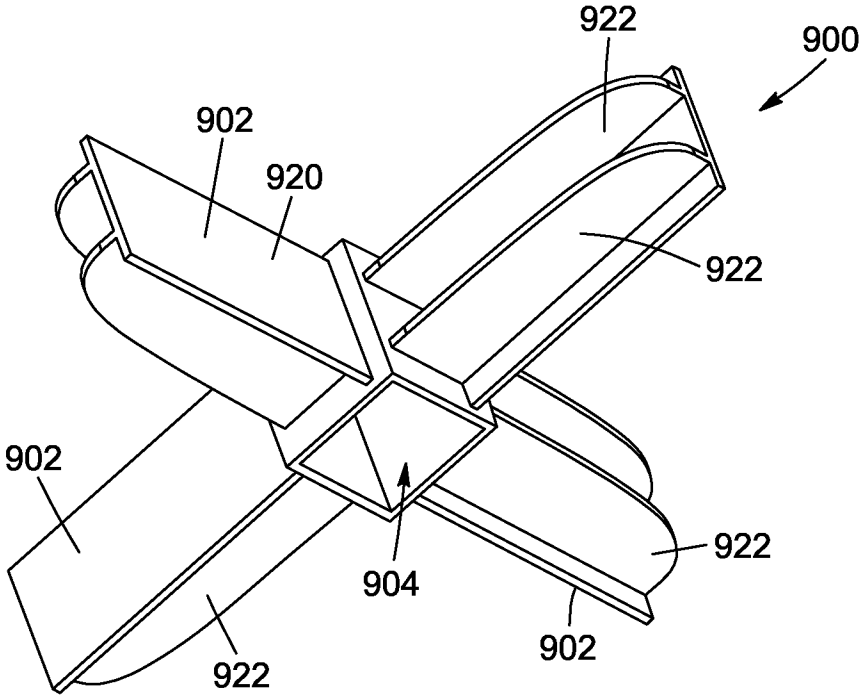

In FIG. 22, the projection 902 is provided integral to a pair of support members 922 outwardly extending from the shaft receiving hub 904. In this implementation, the shaft would rotate in a clockwise direction such that the front facing surface 920 of the projections 902 faces the oil sands material. In the implementation shown in FIG. 22, the projections 902 are illustrated as being provided so as to extend substantially parallelly relative to a longitudinal plane extending along a longitudinal axis of the shaft. The projection 902 can also be said to extend perpendicularly to a transverse plane extending perpendicularly to the longitudinal axis of the shaft. It is to be understood that the projections can also be provided so as to extend at an angle between −45° and +45° relative to a longitudinal plane extending along a longitudinal axis of the shaft.

Figure 23:
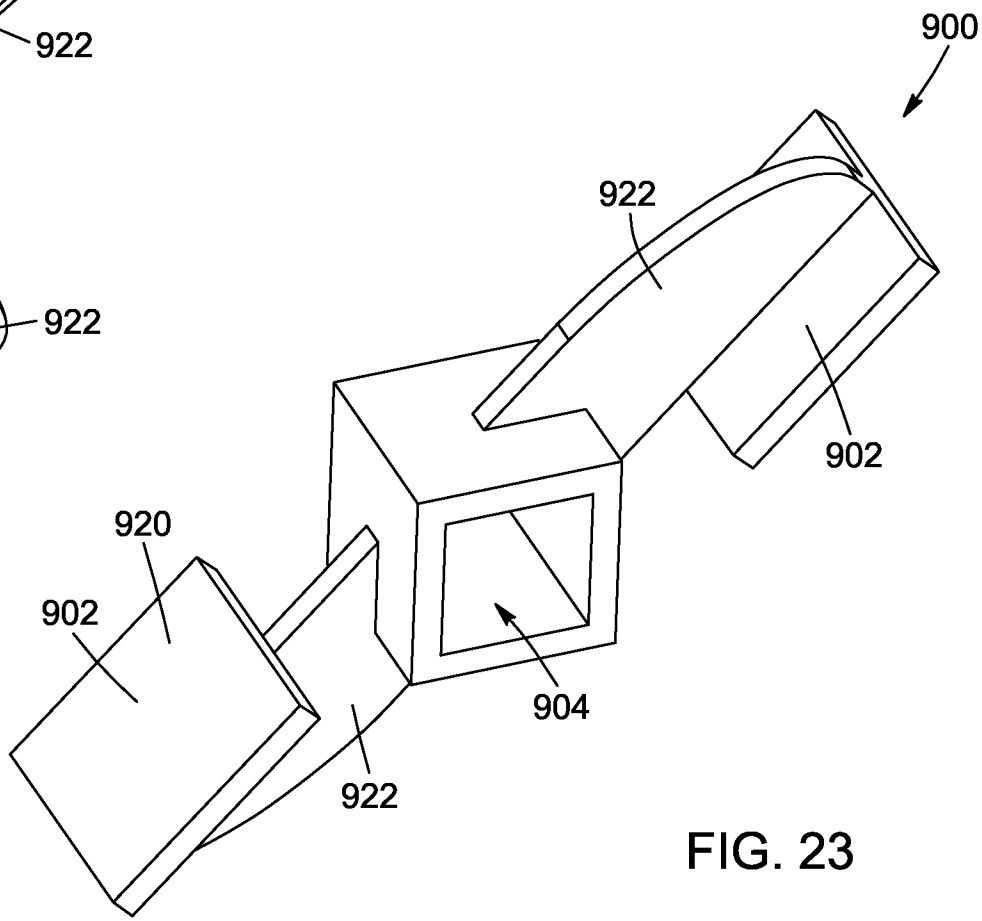

FIG. 23 illustrates an alternative implementation where two projections 902 are provided instead of four projections, each projection 902 being provided integral to a support member 922 extending outwardly from the shaft receiving hub 904. As in the implementation shown in FIG. 23, the shaft would rotate in a clockwise direction such that the front facing surface 920 of the projections 902 faces the oil sands material. In the implementation shown in FIG. 22, the projections 902 are illustrated as being provided so as to extend substantially parallelly relative to a longitudinal plane extending along a longitudinal axis of the shaft. As mentioned above, it is to be understood that the projections can also be provided so as to extend at angle between −45° and +45° relative to a longitudinal plane extending along a longitudinal axis of the shaft.

Figure 24:
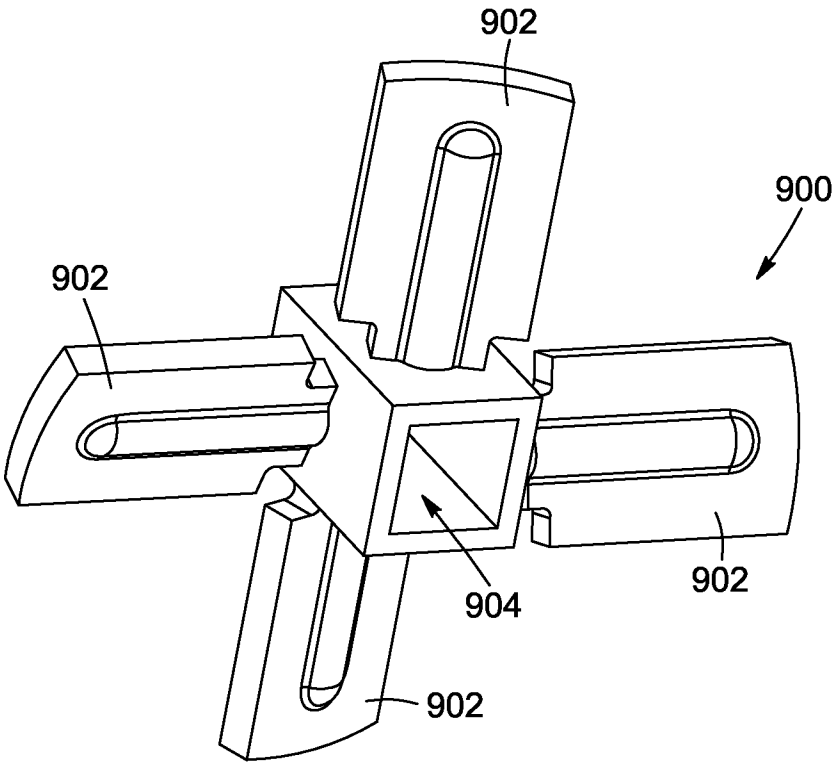

In FIG. 24, the shaft receiving hub 904 and the four projections 902 are integral with each other.

Figure 25:
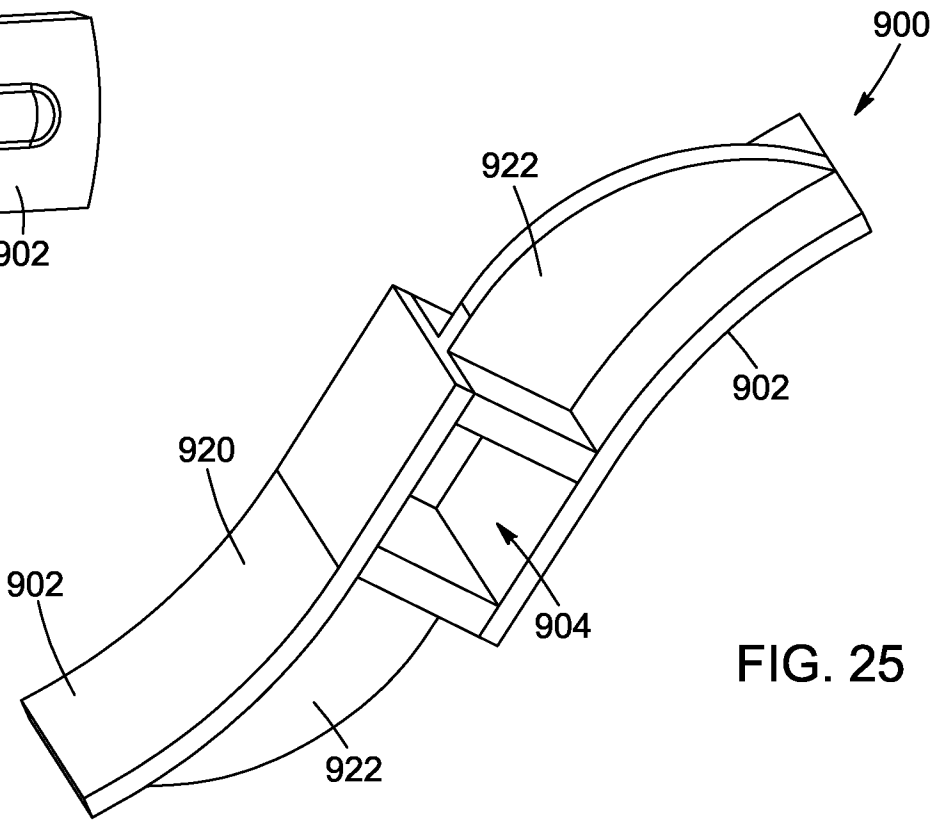

FIG. 25 illustrates an implementation where the projections 902 have a front facing surface 920 that has a curved profile when viewed along a longitudinal axis defined by the shaft. It is to be understood that the projection 902 shown as being integral to the support member 922 can alternatively be engaged therewith with any suitable mechanical fastener or other techniques. Similarly to FIGS. 22 and 23, the projections 902 are illustrated as being provided so as to extend substantially parallelly relative to a longitudinal plane extending along a longitudinal axis of the shaft, although the projections can be angled to extend at an angle between −45° and +45° relative to a longitudinal plane extending along a longitudinal axis of the shaft.

Figure 27:
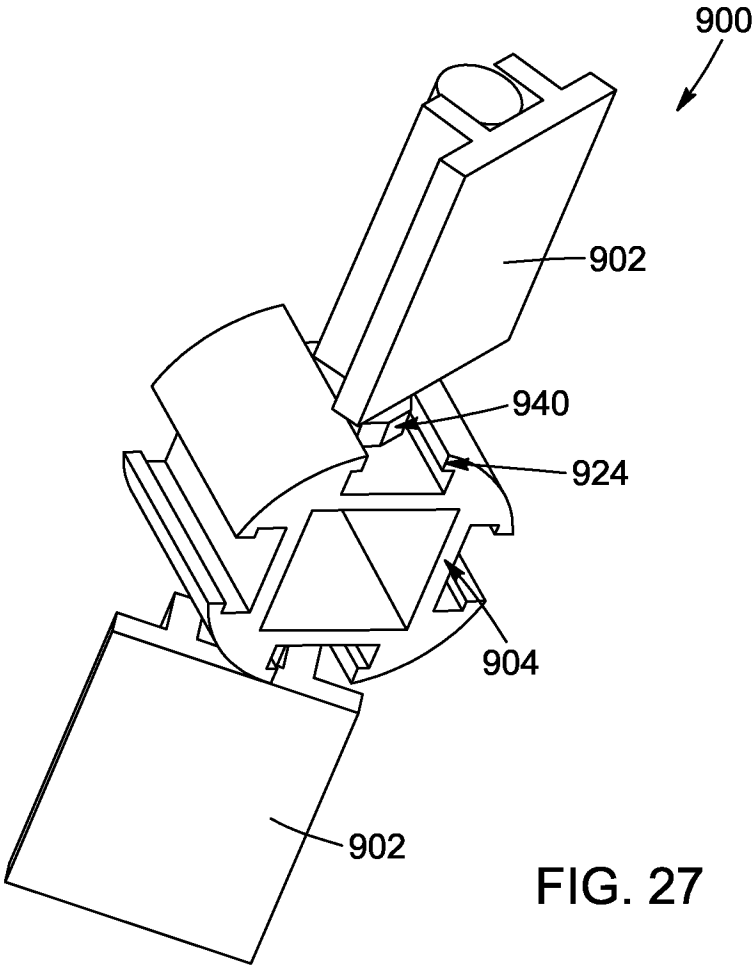
Figure 26:
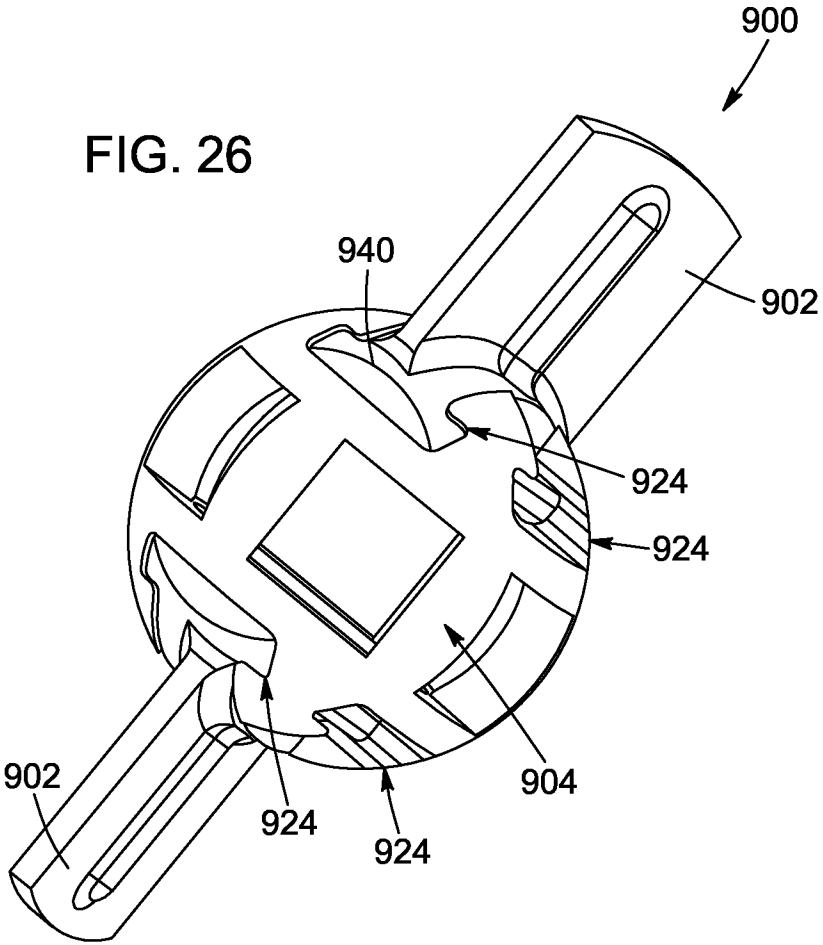

Referring now to FIGS. 26 and 27, the shaft mounting structure 900 shown includes a shaft receiving hub 904 having a dovetail joint 924 for engaging a corresponding projection 902. The projection 902 can include a stem 940 having an end that can be cooperatively slid into a dovetail slot of the hub 904 to prevent outward movement. The projections are therefore removable by sliding back out of the dovetail slot of the hub. In the implementation shown in FIG. 26, each of the dovetail joints 924 provides two orientations for inserting the projections 902 therein, with two dovetail joints 924 intersecting each other. In turn, this configuration of the dovetail joints 924 offers flexibility in the configuration of the projections 902, and more particularly with respect to the angle at which the corresponding projection 902 is provided. In the implementation shown in FIG. 26, the shaft receiving hub 904 includes four dovetail joints 924, which can enable to insert a total of four projections 902 simultaneously if desired. In FIG. 27, the stem 940 has a hexagonal shape which can prevent the projection 902 to rotate on itself. In this implementation, the angle of impact of the projection 902 against the oil sands material creates a rotation tendency that tends to further tighten the projection 902 in its position relative to the shaft receiving hub 904. Alternatively, the stem 940 having a hexagonal shape can have spacers extending on both sides along the dovetail joint 924, the spacers being configured to maintain adjacent projections 902 in a given spaced-apart relationship relative to each other. Alternatively, spacers can extend between projections 902 to maintain adjacent projections 902 in a given spaced-apart relationship relative to each other and prevent projections movement along the shaft.

In FIG. 28, the mounting assembly 910 and the corresponding projection 902 form an integral structure that is directly fastened to the shaft 489 to obtain a rotating element 930. In this configuration, the shaft receiving hub is thus omitted, and the projections 902 can be said to be directly and removably engaged with the shaft 489. The projections 902 and mounting assembly 910 can form an L-shaped structure with an aperture in the bottom section for alignment with a corresponding aperture in the shaft so that a fastener can extend through the apertures for securing the projections to the shaft. The projections can be oriented at different angles by rotation about the fastener prior to tightening, for example.

It is to be understood that the various implementations shown in FIGS. 12 to 28 are provided as examples of combinations of projections with the optional presence of one or more shaft mounting structures, one or more support members, and one or more mounting assemblies and that the different illustrated features can be interchangeable and combinable to arrive at a given configuration of rotating elements having removable projections.

In addition, it is to be understood that when referring to engaging members or fastening members, any type of engaging members or fastening members as known in the art to can be used. Examples of engaging members or fastening members can include, without being limited to, mechanical fasteners such as screws, clamps, clips, interlocking mechanisms, bolts, nails rivets etc. Heat shrink can also be used to secure a given structure to another. For instance, the shaft receiving hub can be affixed to the shaft using a heat shrink technique. Additional techniques can also include gluing a given structure to another. In some implementations, the shaft can include threads, and the shaft receiving hub 604 or a series of shaft receiving hub 604 can be screwed onto the shaft. In yet other implementations, the shaft can be configured to engage the shaft receiving hub 604 or a series of shaft receiving hubs 604 via a dovetail joint. As mentioned above, the shaft receiving hub 604 or a series of shaft receiving hubs 604 can also be slid over the shaft.

The examples of rotating elements illustrated in FIGS. 12 to 28, with regard to the configuration of the projections and spatial relationship in relation to the shaft can be beneficial to cut through the oil sands material and avoid bridging and plugging around the projections. This can be achieved for instance by providing the projections 602 with sufficiently sharp edges to facilitate the cutting action of the projections 602. The projections can be made of metal, such as stainless steel, to provide the sharp edges.

In operation, the extractor having removably mounted projections extending from the shafts can be controlled to mix and advance the mixture of solids, bitumen and solvent along the trough. As noted above, the projections can be removed for inspection, replacement or maintenance, and can also be adjusted to modify positions or angles. The removal or adjustment of the projections can be performed in order to maintain or enhance performance of the extractor, and can be done based on monitoring information. In one example, the orientation of some of the projections can be modified to provide greater mixing energy to the solid bed and to advance the solids more slowly through the trough. Alternatively, the orientation of some of the projections can be changed to provide lower mixing and greater speed through the trough. It is also possible to replace certain projections with a new shape or design in a certain section of the extractor. For example, in high wear sections, it may be desirable to use projections that have higher wear resistance features. In some implementations, the projections can be given a certain configuration for performing tests evaluating the performance of the extractor, for instance in terms of the advancement of the oil sands material along the length of the extractor, the extracting of bitumen from the oil sands material, the washing of the bitumen, etc. Once it has been determined that a given configuration of the projections achieves desired results, the rotating element can be built in that given configuration for future extraction operations. The modular configuration of the projections can thus be used to model the performance of a rotating element, which can change for instance depending on the characteristics of the oil sands material being subjected to extraction. When one or more projections are replaced for instance because of wear or for changing the angle at which the one or more projections are provided, the extractor can be stopped, drained, and replacement can take place. In some implementations, a spare rotating element can be available for replacement.

In the implementations shown in FIGS. 12 to 20, 24, 27 and 28, the projections are shown as being provided at a certain angle relative to a transverse plane extending perpendicularly to the longitudinal axis of the shaft or the projections-receiving shaft, which can be neutral (i.e., projections provided parallel or at 0° relative to the transverse plane extending perpendicularly to the longitudinal axis of the shaft or the projections-receiving shaft), or below or above 0°. The angle at which is provided the projections can influence the direction of rotation of the shaft or the projections-receiving shaft. Projections provided with a neutral angle can also contribute to advancing the oil sands material along the extractor trough, via various mechanisms such as gravity, once the solids are fluidized.

The projections 602 can be made of various materials, such as High Chrome White Iron (HCWI), Chrome White Iron (CWI), chrome carbide, carbon steel, or stainless steel. In some implementations, the projections can be made of a lesser resistance wear material, such as carbon steel, and be coated with a high resistance wear material, such as HCWI, CWI or chrome carbide. In some implementations, the mounting assembly can be made of a lesser resistance wear material compared to the material from which is made the projection.

In some implementations, the rotating elements described with reference to FIGS. 12 to 28 can be implemented when performing ablation of an oil sands material to produce ablated ore, the ablated ore being subsequently subjectable to extraction. In some implementations, the rotating elements described with reference to FIGS. 12 to 28 can also be installed in an auger classifier as described above in reference to the classifier assembly 418 shown in FIGS. 5-8.

Extractor Operation

Referring back to FIGS. 10 and 11, in some implementations, two rotating elements 488 can be configured in parallel relation to each other and can be operated to rotate in opposite directions with respect to one another during regular operation such that they produce an upward movement in the center of the extractor trough 482 and thus a downward movement at the outer edges of the extractor trough 482. The shafts 489 of the rotating elements 488 can also be configured to rotate at substantially the same speed (e.g., between about 50 and 210 rpms) to promote central conveyance, although it is appreciated that other configurations and operating parameters are possible. For example, the rotating elements 488 can be made to rotate in the same direction, or in opposite directions but producing a downward movement in the center of the trough. It should also be noted that the direction of rotation of the rotating elements 488 can be reversed during operation, for example, if material, such as a rock, becomes stuck between the projections of a given rotating element 488. Moreover, the projections of the rotating element 488 can be shaped and sized so as to interlock, or overlap each other in a central region of the extractor trough. However, in a preferred implementation, the projections are spaced from each other in the central region which can promote countercurrent displacement of liquids and solids within the extractor trough.

Referring to FIG. 10, the rotating element shafts 489 can be supported or stabilised within the extractor trough 482 via a support assembly. For example, the support assembly can include at least one support base 490 having inner and outer bearings 492, 494 for operatively connecting the shafts 489 thereto. Alternatively, the shafts 489 can span the entire length of the extractor trough 482, and be simply connected at either end thereof. It should be understood that the shafts 489 are further operatively connected to motors. The motors can be adapted to rotate the shafts independently of each other in a joint or coordinated manner. The motors can be fixed together on a common frame or independently. Various motor constructions and implementations are possible. The motors can be controllable to provide variable rotation speeds and/or torques depending on certain variables of the process.

The extractor trough 482 can have a fluid outlet 496 defined in a trough end plate 498 positioned at an upstream end 484 of the primary extraction assembly 420. The primary extraction assembly 420 can further include one or more outlet tubings connected to the outlet 496 for allowing the solvent diluted bitumen stream (solbit) to exit the extractor trough 482 and prevent overflowing, for example. The outlet 496 can be located in an end section of the trough 482 that is located upstream of a weir 510 over which the solbit flows. The weir 510 can be configured to allow the shafts 489 to pass through its lower section. In some cases, the overflow weir can be omitted. Within the extractor trough 482, solvent diluted bitumen that has been extracted from the oil sands material separates upstream from the solids which are then advanced downstream. The solvent diluted bitumen forms a liquid zone above a lower solids zone, and a stream of solvent diluted bitumen can be withdrawn via the outlet 496.

Referring still to FIG. 10, the primary extraction assembly 420 can further include the following components, among others: windows 502 and window frames 504; one or more centre ridges 506 provided along the bottom surface of the extractor trough 482; a top cover plate 508 that includes the ore inlet 509; a weir assembly 510; rotary shaft seals 512; and pump shaft seals 514. The primary extraction assembly 420 can include sample ports along its length to obtain samples of solbit in order to test the composition for process control purposes, for example. The windows 502 can be provided for visual inspection within the extractor and/or to facilitate access to certain parts of the trough. It should be noted that the particular construction of the primary extraction assembly 420 can vary and may have a number of differences compared to the example illustrated in FIG. 10.

In some implementations, the extractor 142 can be constructed to include a sealed envelope 544, as illustrated in FIG. 6, which can include walls of the classifier assembly 418 (i.e., walls of the classifier trough 426) and walls of the primary extraction assembly 420 (i.e., walls of the extractor trough 482) with appropriate seals. The walls include the side, bottom, top and ends of the extractor. The envelope 544 ensures that solvent vapour is retained within its interior, and also enables controlling the pressure within the units of the extractor (i.e., enables control of a safe atmosphere). In this regard, providing the classifier assembly 418 and the primary extraction assembly 420 with fixed stationary troughs and respective rotating elements, such as augers or log washers, enables the troughs to generally form the sealed envelope 544.

In operation, the oil sands material (e.g., sized ore) is fed to an upstream end of the extractor trough 482 via a feedwell or inlet so as to form a solid rich zone in the lower part of the extractor trough. Solvent (e.g., fresh solvent and/or a solvent rich solbit stream) is supplied to a non-submerged part (e.g., downstream end) of the classifier trough 426 and flows upstream as it dissolves bitumen and becomes progressively more enriched in bitumen as it flows upstream. The sizing of the troughs and the feed rates of the oil sands and the solvent are provided so that the solbit in the extractor trough submerges all of the solids, thereby forming a lower region that is rich in solids and an upper region that is rich in liquid. The rotating elements 488 operate within the solids rich region, with portions of the projections extending above the solids/liquid interface in order to promote mixing of the two phases together such that substantially the entire content of the extractor trough becomes a light slurry. In addition, it should be noted that the pair of rotating elements 488 can be spaced relative to each other such that the projections overlap in a central region, do not overlap and are thus spaced apart or arrive at substantially the same central location. The lower part of the classifier trough 426 and the transition 429 are also filled with enough solbit to submerge the solids, but the upper part of the classifier trough is above the liquid level to facilitate back drainage. The liquid level can be monitored within the troughs and the operating parameters can be adjusted to control a desired liquid level and/or desired features of the solids and liquid rich regions.

The extractor can be operated under various conditions. For example, the primary extraction assembly 420 can be operated under conditions such that the solids rich zone has different slurry densities and forms a slump bed or an expanded bed. For example, in test runs, operating conditions were provided to generate a bed density of about 1.1 g/mL in the solids rich zone which resulted in expanded fluidized bed conditions. In expanded fluidized bed conditions, there existed some differences in solids content between the top and bottom layers. Operating conditions were also provided to generate a bed density of up to about 1.9 g/mL in the solids rich zone which resulted in slumped bed conditions. In slumped bed conditions, counter-current flow of the solids and solbit can be facilitated and therefore operating with bed densities and other parameters that provide slumped bed conditions can be desirable in some circumstances. Nevertheless, expanded fluidized bed conditions can facilitate fluid passing through the solids and therefore can provide enhanced performance and can be desirable.

Regarding the implementation illustrated in FIG. 5, the extractor can facilitate combining digestion, extraction, separation, as well as countercurrent washing in a single unit. Digestion, extraction and separation are promoted in the primary extraction assembly 420 and in the bottom of the classifier assembly 418; while some extraction, separation and counter-current washing are promoted in the upper part of the classifier assembly 418 and the upper, liquid portion of the primary extraction assembly 420.

Applications of NAE Techniques to Oil Containing Materials

As mentioned above, the NAE methods and systems can be applied for processing bitumen containing materials, such as oil sands ore, to extract bitumen. Various oil sands ores as well as other bitumen and mineral solids containing materials can be processed using NAE.

In some implementations, the oil sands material can be low grade Athabasca oil sands. The NAE process extracts high levels of bitumen regardless of ore grade (within ranges tested). The NAE process can cost effectively extract low grade oil sands. It is estimated that many millions of barrels of bitumen is contained in high fines or high clay ores that are difficult to process using aqueous extraction techniques. The NAE techniques can also receive oil sands ores that vary in grade over time without the need to significantly modify operating parameters, thus facilitating continuous processing of mined ore regardless of ore grade.

In some implementations, the oil sands material can be oil sands not processable by hot water extraction methods. This technology could be applied to other types of oil sands from other deposits around the world, beyond Canadian oil sands deposits. For example, oil sands from Utah that are not water-wet like Athabasca oil sands and not readily extracted by aqueous processes, could be processed using NAE techniques. Thus, oil-wet oil sands ore could be processed using NAE.

In some implementations, the oil sands material can be contaminated soil such that the NAE process is used for remediation. Hydrocarbon-contaminated soils from spills or leaks and industrial sites (e.g., manufacturing, service and storage) contaminated with leaked liquid hydrocarbons can also be ameliorated and cleaned up using NAE processes.

Alternative Implementations

It should also be noted that some units and processes described herein can be used in connection with other types of oil sands processing techniques that can involve the addition of water alone or in combination with solvent. Such techniques would not be considered non-aqueous bitumen extraction and can involve adapting the units and processes to water addition and associated handling of aqueous streams. For example, certain integrated extraction units described herein could be adapted for use with aqueous techniques, although equipment sizing, operating parameters including residence time, temperatures, pressures, and the like would be modified compared to non-aqueous extraction.

It is also noted that some implementations described herein can be used for the non-aqueous extraction of other valuable materials from mined ore as well as the treatment and handling of process streams such as oil containing tailings. Of course, the type of solvent as well as equipment sizing and design can be adapted for the extraction of other materials.

Several alternative implementations and examples have been described and illustrated herein. The implementations of the technology described above are intended to be exemplary only. A person of ordinary skill in the art would appreciate the features of the individual implementations, and the possible combinations and variations of the components. A person of ordinary skill in the art would further appreciate that any of the implementations could be provided in any combination with the other implementations disclosed herein. It is understood that the technology may be embodied in other specific forms without departing from the central characteristics thereof. The present implementations and examples, therefore, are to be considered in all respects as illustrative and not restrictive, and the technology is not to be limited to the details given herein. Accordingly, while the specific implementations have been illustrated and described, numerous modifications come to mind.

The invention claimed is:

1. An extraction assembly for non-aqueous extraction of bitumen from oil sands, the extraction assembly comprising:

an extractor trough comprising a liquid outlet in an upstream region thereof; and a rotating element receivable within the extractor trough, the rotating element comprising:

a shaft operatively couplable to a motor configured for driving a rotation of the shaft;

a shaft mounting structure couplable to the shaft, comprising:

a shaft receiving hub having a shaft receiving hub profile and being configured for receiving the shaft therein; and projections extending outwardly from the shaft and being removably secured thereto via the shaft receiving hub;

wherein rotation of the rotating element provides digestion and extraction of bitumen from the oil sands while advancing solids in a downstream direction within the extractor trough, as solvent diluted bitumen accumulates in an upper region of the extractor trough and flows in an upstream direction toward the liquid outlet.

2. The extraction assembly of claim 1, wherein the projections are integral with the shaft receiving hub.

3. The extraction assembly of claim 1, wherein the shaft mounting structure further comprises a mounting assembly for removably engaging a corresponding one of the projections with the shaft receiving hub.

4. The extraction assembly of claim 3, wherein the mounting assembly comprises a single mechanical fastener extending across the shaft receiving hub and the shaft to secure two opposite projections together.

5. The extraction assembly of claim 1, wherein the rotating element comprises at least two rotating elements receivable within the extractor trough and provided side-by-side relative to each other.

6. The extraction assembly of any one of claim 1, wherein the shaft mounting structure comprises a plurality of shaft mounting structures mounted in series onto the shaft and each having a corresponding shaft receiving hub.

7. The extraction assembly of claim 6, wherein the plurality of shaft mounting structures are configured such that adjacent shaft receiving hubs interlock with each other.

8. The extraction assembly of claim 1, wherein the rotating element further comprises a retaining member at each end to retain the plurality of shaft mounting structures onto the shaft.

9. The extraction assembly of claim 1, wherein the shaft receiving hub profile is an edgeless profile.

10. The extraction assembly of claim 1, wherein the shaft receiving hub profile is a polygonal profile.

11. The extraction assembly of claim 1, wherein the shaft receiving hub profile includes four outer surfaces, with a corresponding projection of a set of four of the projections extend outwardly from a corresponding one of the four outer surfaces of the shaft receiving hub.

12. The extraction assembly of claim 1, wherein the projections extend at angle between −45° and +45° relative to a longitudinal plane extending along a longitudinal axis of the shaft.

13. The extraction assembly of claim 1, wherein the shaft mounting structure further comprises at least one support member extending outwardly therefrom for supporting a corresponding one of the projections.

14. The extraction assembly of claim 13, wherein the at least one support member and the corresponding one of the projections are integral with each other.

15. The extraction assembly of claim 1, wherein the projections are removably secured to the shaft receiving hub via a corresponding dovetail joint.

16. The extraction assembly of claim 1, wherein the projections have a front facing surface having a curved profile when viewed along the longitudinal axis of the shaft.

17. A projection assembly for a rotating element placeable within an extractor trough of an extractor, the projection assembly comprising:

a shaft mounting structure couplable to a shaft, comprising:

a shaft receiving hub having a shaft receiving hub profile and being configured for receiving the shaft therein; and projections extending outwardly from the shaft and being removably secured thereto via the shaft receiving hub, wherein rotation of the projection assembly enables contact of the projections with a slurry receivable in the extractor trough to move the slurry in a downstream direction along the extractor trough.

18. The projection assembly of claim 17, wherein the projections are integral with the shaft receiving hub.

19. The projection assembly of claim 17, wherein the shaft mounting structure further comprises a mounting assembly for removably engaging a corresponding one of the projections with the shaft receiving hub.

20. The projection assembly of claim 19, wherein the mounting assembly comprises a single mechanical fastener extending across the shaft receiving hub and the shaft to secure two opposite projections together.

21. The projection assembly of claim 17, wherein the shaft mounting structure comprises a plurality of shaft mounting structures mountable in series onto the shaft and each having a corresponding shaft receiving hub.

22. The projection assembly of claim 21, wherein the plurality of shaft mounting structures are configured such that adjacent shaft receiving hubs interlock with each other.

23. The projection assembly of claim 17, wherein the shaft receiving hub profile includes four outer surfaces, with a corresponding projection of a set of four of the projections extend outwardly from a corresponding one of the four outer surfaces of the shaft receiving hub.

* * * * *